US010955773B2

(12) United States Patent
Yamaura et al.

(10) Patent No.: US 10,955,773 B2
(45) Date of Patent: Mar. 23, 2021

(54) IMAGE FORMING APPARATUS HAVING TRANSFER SECTION SWITCHING BETWEEN A CONSTANT VOLTAGE CONTROL AND CONSTANT CURRENT CONTROL

(71) Applicant: FUJI XEROX CO., LTD., Tokyo (JP)

(72) Inventors: Masaaki Yamaura, Kanagawa (JP); Satoshi Shigezaki, Kanagawa (JP); Yoshiyuki Tominaga, Kanagawa (JP); Jun Kuwabara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/545,047

(22) Filed: Aug. 20, 2019

(65) Prior Publication Data

US 2020/0292957 A1 Sep. 17, 2020

(30) Foreign Application Priority Data

Mar. 14, 2019 (JP) ..... JP2019-047225

(51) Int. Cl.
*G03G 15/16* (2006.01)
*G03G 15/00* (2006.01)
(Continued)

(52) U.S. Cl.
CPC ..... *G03G 15/1675* (2013.01); *G03G 15/5029* (2013.01); *G03G 15/0136* (2013.01);
(Continued)

(58) Field of Classification Search
CPC ..... G03G 15/1675; G03G 15/5029; G03G 2215/00763; G03G 2215/00949
(Continued)

(56) References Cited

U.S. PATENT DOCUMENTS

2017/0277120 A1* 9/2017 Miyoshi ..... G03G 21/203
2018/0024474 A1* 1/2018 Takenaka ..... G03G 15/1675 399/66
2019/0107798 A1* 4/2019 Miyamoto ..... G03G 15/1695

FOREIGN PATENT DOCUMENTS

JP 09297476 A * 11/1997
JP 09329977 A * 12/1997
(Continued)

*Primary Examiner* — Robert B Beatty
(74) *Attorney, Agent, or Firm* — Sughrue Mion, PLLC

(57) ABSTRACT

An image forming apparatus includes: an image holding section; a transfer section that includes a transfer member, applies a transfer electric-field to a transfer region between the image holding section and the transfer member, and electrostatically transfers an image held by the image holding section onto a recording medium; a contact section that acts as an electrode to ground while being in contact with the recording medium when the recording medium passes through the transfer region; a first resistance detection section; a second resistance detection section; a comparison section that compares a first system resistance detected by the first resistance detection section with a second system resistance detected by the second resistance detection section; and a switching section that switches between constant voltage control and constant current control for the transfer electric-field produced by the transfer section depending on a result of comparison by the comparison section.

8 Claims, 17 Drawing Sheets

(51) Int. Cl.
*G03G 15/01* (2006.01)
*G03G 15/20* (2006.01)

(52) U.S. Cl.
CPC ..... *G03G 15/205* (2013.01); *G03G 15/5008* (2013.01); *G03G 2215/00763* (2013.01); *G03G 2215/00949* (2013.01)

(58) Field of Classification Search
USPC ..... 399/66, 314, 396
See application file for complete search history.

(56) References Cited

FOREIGN PATENT DOCUMENTS

| | | | | | |
|---|---|---|---|---|---|
| JP | 11272098 | A | * | 10/1999 | |
| JP | 2000235308 | A | * | 8/2000 | |
| JP | 2001312160 | A | * | 11/2001 | |
| JP | 2002202671 | A | * | 7/2002 | ..... G03G 15/1675 |
| JP | 3346091 | B2 | | 11/2002 | |
| JP | 2004045897 | A | * | 2/2004 | |
| JP | 2007-212617 | A | | 8/2007 | |
| JP | 4946081 | B2 | | 6/2012 | |
| JP | 2015075703 | A | * | 4/2015 | |
| JP | 2018-141833 | A | | 9/2018 | |

* cited by examiner

FIG. 15

| | 6log Ω/cm PRODUCT | | 13log Ω/cm PRODUCT | |
|---|---|---|---|---|
| | WHITE + Blue WHOLE SURFACE SOLID | WHITE MONOCHROME/ WHITE + Blue PATCH | WHITE + Blue WHOLE SURFACE SOLID | WHITE MONOCHROME/ WHITE + Blue PATCH |
| ① CONSTANT VOLTAGE CONTROL (COMPARATIVE EXAMPLE 1) | X (WHOLE SURFACE ROUGHNESS/ DENSITY DIFFERENCE OF REAR END PORTION OF PAPER) | X (PATCH IMAGE ROUGHNESS) | ○ | ○ |
| ② CONSTANT CURRENT CONTROL (COMPARATIVE EXAMPLE 2) | ○ | Δ (WHITE MONOCHROME AND LOW DENSITY) | ○ | Δ (WHITE MONOCHROME AND LOW DENSITY) |
| ③ CONSTANT VOLTAGE/ CONSTANT CURRENT SWITCHING CONTROL (EXAMPLE 1) | ○ | Δ (WHITE MONOCHROME AND LOW DENSITY) | ○ | ○ |

○: OPTIMUM IMAGE QUALITY Δ: PASSED IMAGE QUALITY ×: THERE IS IMAGE QUALITY DEFECT

IMAGE FORMING APPARATUS HAVING TRANSFER SECTION SWITCHING BETWEEN A CONSTANT VOLTAGE CONTROL AND CONSTANT CURRENT CONTROL

CROSS-REFERENCE TO RELATED APPLICATIONS

This application is based on and claims priority under 35 USC 119 from Japanese Patent Application No. 2019-047225 filed Mar. 14, 2019.

BACKGROUND

(i) Technical Field

The present disclosure relates to an image forming apparatus.

(ii) Related Art

In the related art, known image forming apparatuses include, for example, those described in JP-A-2018-141833, JP-A-2007-212617, and JP-B-3346091.

JP-A-2018-141833 (see FIG. 4 in DETAILED DESCRIPTION) discloses an image forming apparatus including a transfer member which transfers a toner image on an image carrying body to a long recording medium, an opposite member in contact with an inner peripheral surface of the image carrying body to face the transfer member, a voltage applying section which applies a DC voltage to the opposite member at a transfer position at which the transfer member in a state of being grounded is in contact with the opposite member across the image carrying body, and a control section which controls the voltage applying section so that a current flowing through the transfer section becomes a predetermined value.

JP-A-2007-212617 (see FIG. 2 in DETAILED DESCRIPTION) discloses an image forming apparatus including a transfer member which nips a recording material with an image carrying body, a control unit which performs constant voltage control on a transfer voltage supplied from a transfer power supply, a measurement unit which measures a value of a current flowing through the transfer member by a transfer voltage being applied during a transfer operation of transferring an image on the image carrying body to a recording material, and a determination unit which determines whether or not to reset a magnitude of the transfer voltage on which the control unit performs the constant voltage control based on the current value measured by the measurement unit.

JP-B-3346091 (see FIGS. 2 and 3 in Example) discloses an image forming apparatus including a current detection section which detects, in a mode in which a belt-shaped image carrying body is interposed between a bias roll and a backup roll, a current flowing through the bias roll at the time of contact and separation between the bias roll and the image carrying body, a calculation section which determines the voltage applied to the bias roll based on the value detected by the current detection section, and a voltage control section which applies a transfer voltage to the bias roll based on a result of calculation by the calculation section.

SUMMARY

Aspects of non-limiting embodiments of the present disclosure relate to keeping, in a proper range, a transfer electric-field in the transfer region even in a case where different types of recording media pass through the transfer region of the transfer unit and the transfer current path varies depending on the type of the recording medium passing through the transfer region.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: an image holding section that holds an image; a transfer section that includes a transfer member disposed in contact with an image holding surface of the image holding section and an opposite member disposed at a position facing the transfer member across the image holding section, connects a transfer power supply to the opposite member to apply a transfer electric-field to a transfer region between the image holding section and the transfer member, and electrostatically transfers the image held by the image holding section onto a recording medium transported to the transfer region; a contact section that is provided upstream of the recording medium in a direction of transport of the recording medium across the transfer region and acts as an electrode to ground while being in contact with the recording medium when the recording medium passes through the transfer region; a first resistance detection section that detects a system resistance between the transfer member, the image holding section, and the opposite member when the recording medium is interposed in the transfer region; a second resistance detection section that detects a system resistance between the contact section, the image holding section, and the opposite member when the recording medium is interposed between the transfer region and the contact section; a comparison section that compares a first system resistance detected by the first resistance detection section with a second system resistance detected by the second resistance detection section; and a switching section that switches between constant voltage control and constant current control for the transfer electric-field produced by the transfer section depending on a result of comparison by the comparison section.

BRIEF DESCRIPTION OF THE DRAWINGS

Exemplary embodiments of the present invention will be described in detail based on the following figures, wherein:

FIG. 15 is an explanatory diagram illustrating image quality evaluation results on the image forming apparatus in Example 1 and Comparative Examples 1 and 2 for a piece of low resistance paper (6 log Ω·cm product) and a piece of non-low resistance paper (13 log Ω·cm product);

DETAILED DESCRIPTION

Outline of Exemplary Embodiment

Figure 1:
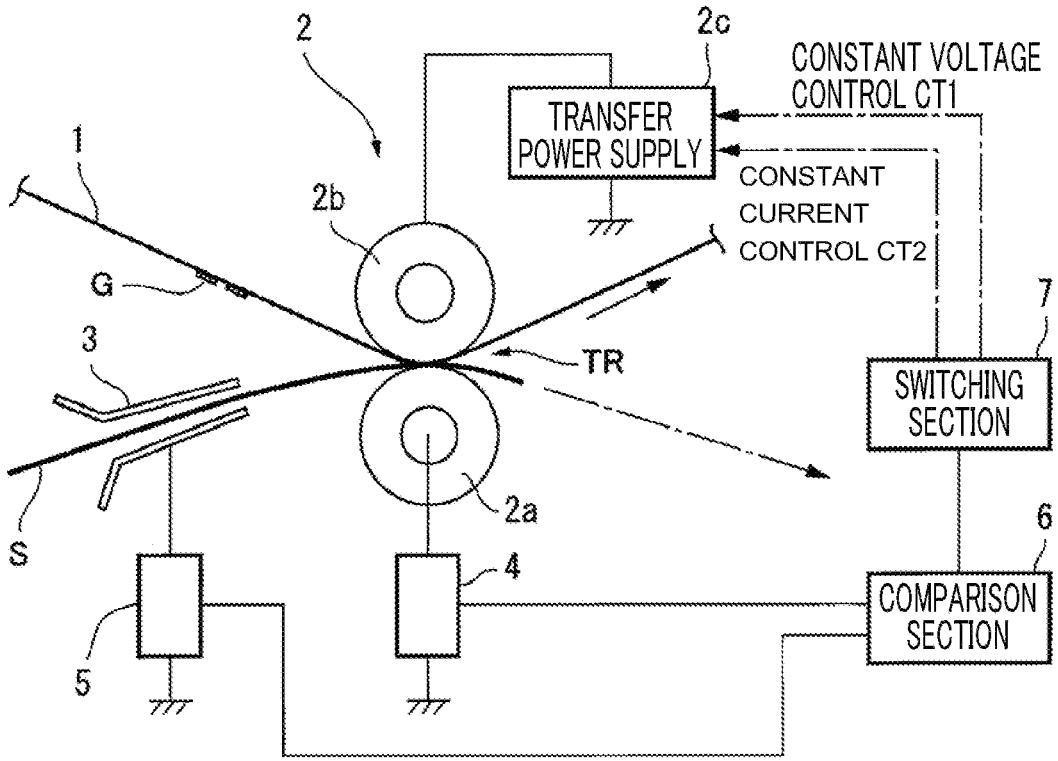
FIG. 1 is an explanatory diagram illustrating an outline of an exemplary embodiment of an image forming apparatus to which the present disclosure is applied.

FIG. 1 is an explanatory diagram illustrating an outline of an exemplary embodiment of an image forming apparatus to which the present disclosure is applied.

In FIG. 1, the image forming apparatus includes: an image holding section 1 which holds an image G; a transfer section 2 which includes a transfer member 2*a* disposed in contact with an image holding surface of the image holding section 1 and an opposite member 2*b* disposed at a position facing the transfer member 2*a* across the image holding section 1, connects a transfer power supply 2*c* to the opposite member 2*b* so as to apply a transfer electric-field to a transfer region TR between the image holding section 1 and the transfer member 2*a*, and electrostatically transfers the image G held by the image holding section 1 onto a recording medium S transported to the transfer region TR; a contact section 3 which is provided upstream of the recording medium S in the direction of transport of the recording medium S across the transfer region TR and acts as an electrode to ground while being in contact with the recording medium S when the recording medium S passes through the transfer region TR; a first resistance detection section 4 which detects a system resistance between the transfer member 2*a*, the image holding section 1, and the opposite member 2*b* when the recording medium S is interposed in the transfer region TR; a second resistance detection section 5 which detects a system resistance between the contact section 3, the image holding section 1, and the opposite member 2*b* when the recording medium S is interposed between the transfer region TR and the contact section 3; a comparison section 6 which compares a first system resistance detected by the first resistance detection section 4 with a second system resistance detected by the second resistance detection section 5; and a switching section 7 which switches between constant voltage control $CT_1$ and constant current control $CT_2$ for the transfer electric-field produced by the transfer section 2 depending on the result of comparison by the comparison section 6.

In such a technical section, the image holding section 1 is not limited to an intermediate transfer body of an intermediate transfer method, but includes a photosensitive member in a direct transfer method and a dielectric.

In addition, the transfer section 2 may include the transfer member 2*a*, the opposite member 2*b*, and the transfer power supply 2*c*, but in a mode of connecting the transfer power supply 2*c* to the transfer member 2*a*, a transfer operation to a low-resistance recording medium cannot be performed, so that the mode is excluded.

Further, the transfer section 2 needs to be capable of switching between the constant voltage control $CT_1$ and the constant current control $CT_2$ on a transfer electric-field.

Furthermore, as long as the contact section 3 is to be grounded other than in a mode of not being grounded (float), the contact section 3 also widely includes direct grounding, resistance grounding, and bias grounding.

In addition, each of the first resistance detection section 4 and the second resistance detection section 5 may directly detect a system resistance, or may be an ammeter which measures a current capable of indirectly obtaining the system resistance.

Further, as the switching section 7, any section may be used as long as the constant voltage control $CT_1$ and the constant current control $CT_2$ on a transfer electric-field are switched depending on the result of comparison by the comparison section 6.

According to the present exemplary embodiment having such a configuration, even in a case where a transfer current path differs depending on a type of the recording medium S passing through the transfer region TR, it is possible to keep the transfer electric-field in the transfer region TR within an appropriate range of the transfer electric-field, that is, a range necessary to appropriately perform the transfer operation.

Next, a typical or specific mode of the image forming apparatus according to the present exemplary embodiment will be described.

Typically, the first resistance detection section 4 and the second resistance detection section 5 perform detection when the recording medium S passes through the transfer region TR in an image forming mode. In the present example, the first and second system resistances are detected in the image forming mode.

Specifically, the detection operation may be performed when a non-image forming region on the front end side in the direction of transport of the recording medium S passes through the transfer region TR. In the present example, a system resistance is detected when the non-image forming region (corresponding to a margin) on the front end side in the direction of transport of the recording medium S passes through the transfer region TR, so that the conditions for transfer in the image forming region of the recording medium S can be set by feeding back the detection result.

In addition, the switching by the switching section 7 may be such that when the second system resistance is smaller than the first system resistance, the constant current control $CT_2$ is selected for the transfer electric-field produced by the transfer section 2. In the present example, when the second system resistance is smaller than the first system resistance, it is determined that the recording medium S has a low resistance, and the constant current control $CT_2$ is performed.

In addition, when the second system resistance is equal to or larger than the first system resistance, the constant voltage control $CT_1$ is selected for the transfer electric-field produced by the transfer section 2. In the present example, when the second system resistance is equal to or larger than the first system resistance, it is determined that the recording medium S has a high resistance and leakage of the transfer current via the recording medium S is small, so that the constant voltage control $CT_1$ is performed.

In addition, in the present exemplary embodiment where an image type (a monochromatic image or a multicolor image) is taken into account, when the constant current control $CT_2$ is selected for the transfer electric-field produced by the transfer section 2, different currents may be set for the transfer electric-field produced by the transfer section 2 depending on whether the image G held by the image holding section 1 is a monochromatic image or a multicolor image. In the present example, different currents may be set for the transfer electric-field depending on the image type, and the current may be set higher for the multicolor image than for the monochromatic image.

Further, in another exemplary embodiment, when the constant current control $CT_2$ is selected for the transfer electric-field produced by the transfer section 2, the recording medium S may be allowed to pass at different speeds through the transfer region TR depending on whether the image G held by the image holding section 1 is a monochromatic image or a multicolor image. In the present example, the recording medium S may have different speeds depending on the image type, and the speed of the recording medium S may be set lower for the multicolor image than for the monochromatic image.

Another example of a typical detection operation by the first and second resistance detection sections 4 and 5 may be such that, in a non-image forming mode, a recording medium for detection of the same type as the recording medium S is transported to the transfer region TR and detected. In the present example, the first and second system resistances may be detected in the non-image forming mode, and a recording medium for detection of the same type as the recording medium S may pass through the transfer region TR so as to detect each system resistance.

Hereinafter, the present disclosure will be described in detail based on the exemplary embodiments illustrated in accompanying drawings.

Exemplary Embodiment 1

Figure 2:
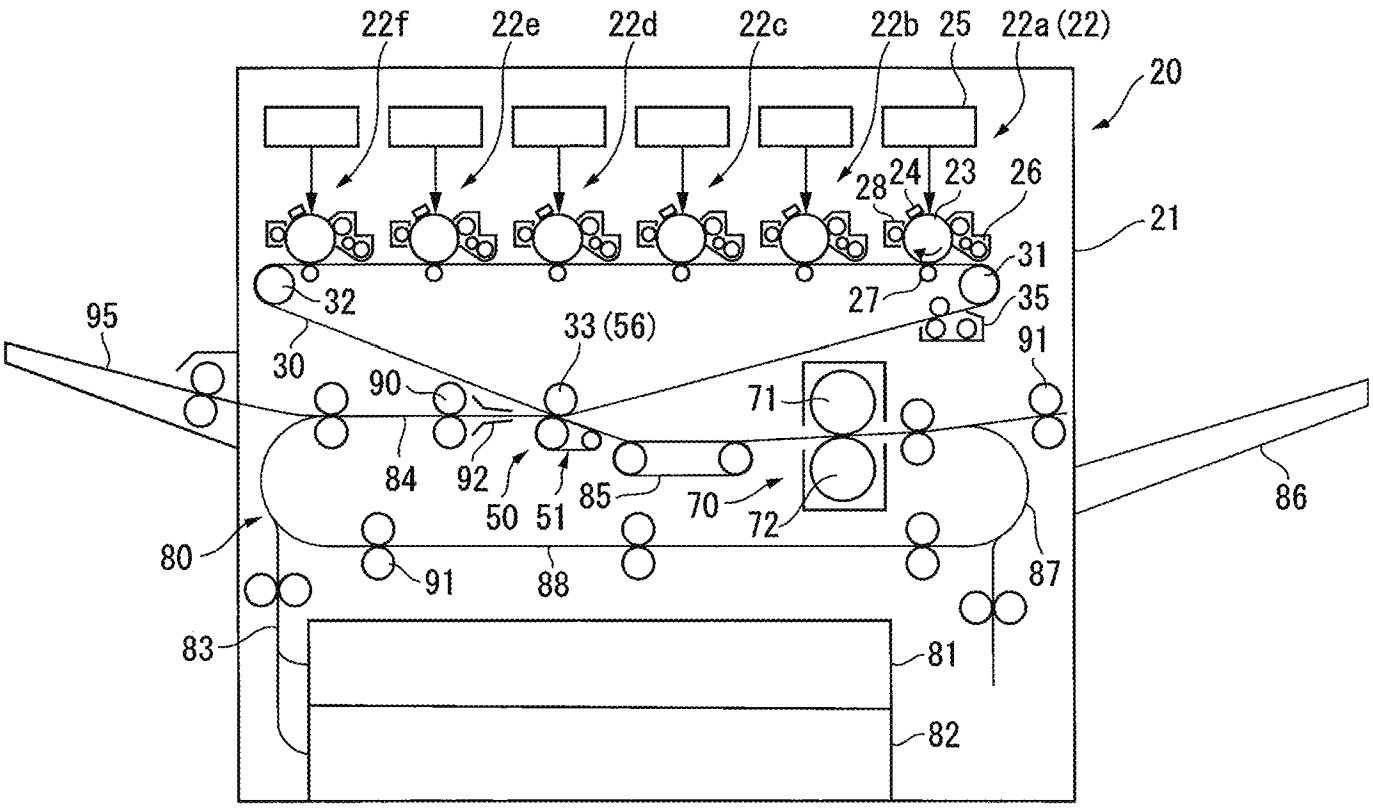
FIG. 2 is an explanatory diagram illustrating an overall configuration of an image forming apparatus according to Exemplary Embodiment 1.

FIG. 2 is an explanatory diagram illustrating an overall configuration of an image forming apparatus according to Exemplary Embodiment 1.

Overall Configuration of Image Forming Apparatus

In FIG. 2, an image forming apparatus 20 includes an image forming unit 22 (specifically, 22*a* to 22*f*) which forms plural color component (white #1, yellow, magenta, cyan, black, and white #2 in the present exemplary embodiment) images, a belt-shaped intermediate transfer body 30 which sequentially transfers (primarily transfers) and holds each of the color component images formed by each of the image forming units 22, a secondary transfer device (collective transfer device) 50 which secondarily transfers (collectively transfers) each of the color component images transferred onto the intermediate transfer body 30 onto a piece of paper S (see FIG. 3) as a recording medium, a fixing device 70 which fixes the secondarily transferred image on the paper S, and a paper transport system 80 which transports the paper S to the secondary transfer region, in an image forming apparatus housing 21. In the present example, white #1 and white #2 use the same white material, but different materials may be used depending on whether positions are at a lower layer or an upper layer from the other color component images on the paper S. In addition, for example, a transparent material may be used instead of one white #1.

Image Forming Unit

In the present exemplary embodiment, each of the image forming units 22 (22*a* to 22*f*) includes a drum-shaped photosensitive member 23. Around each photosensitive member 23, each image forming unit includes a charging device 24 such as a corotron, a transfer roll, or the like, which charges the photosensitive member 23, an exposure device 25 such as a laser scanning device or the like in which an electrostatic latent image is written on the charged photosensitive member 23, a developing device 26 which develops the electrostatic latent image written on the photosensitive member 23 by each color component toner, a primary transfer device 27 such as a transfer roll or the like in which a toner image on the photosensitive member 23 is transferred to the intermediate transfer body 30, and a photoconductor cleaning device 28 which removes residual toner on the photosensitive member 23.

In addition, the intermediate transfer body 30 is stretched over plural (three in the present exemplary embodiment) tension rolls 31 to 33, for example, the tension roll 31 is used as a driving roll driven by a drive motor (not illustrated), and is circulated and moved by the driving roll. Further, an intermediate transfer body cleaning device 35 which removes a residual toner on the intermediate transfer body 30 after a secondary transfer is provided between the tension rolls 31 and 33.

Secondary Transfer Device (Collective Transfer Device)

Figure 3:
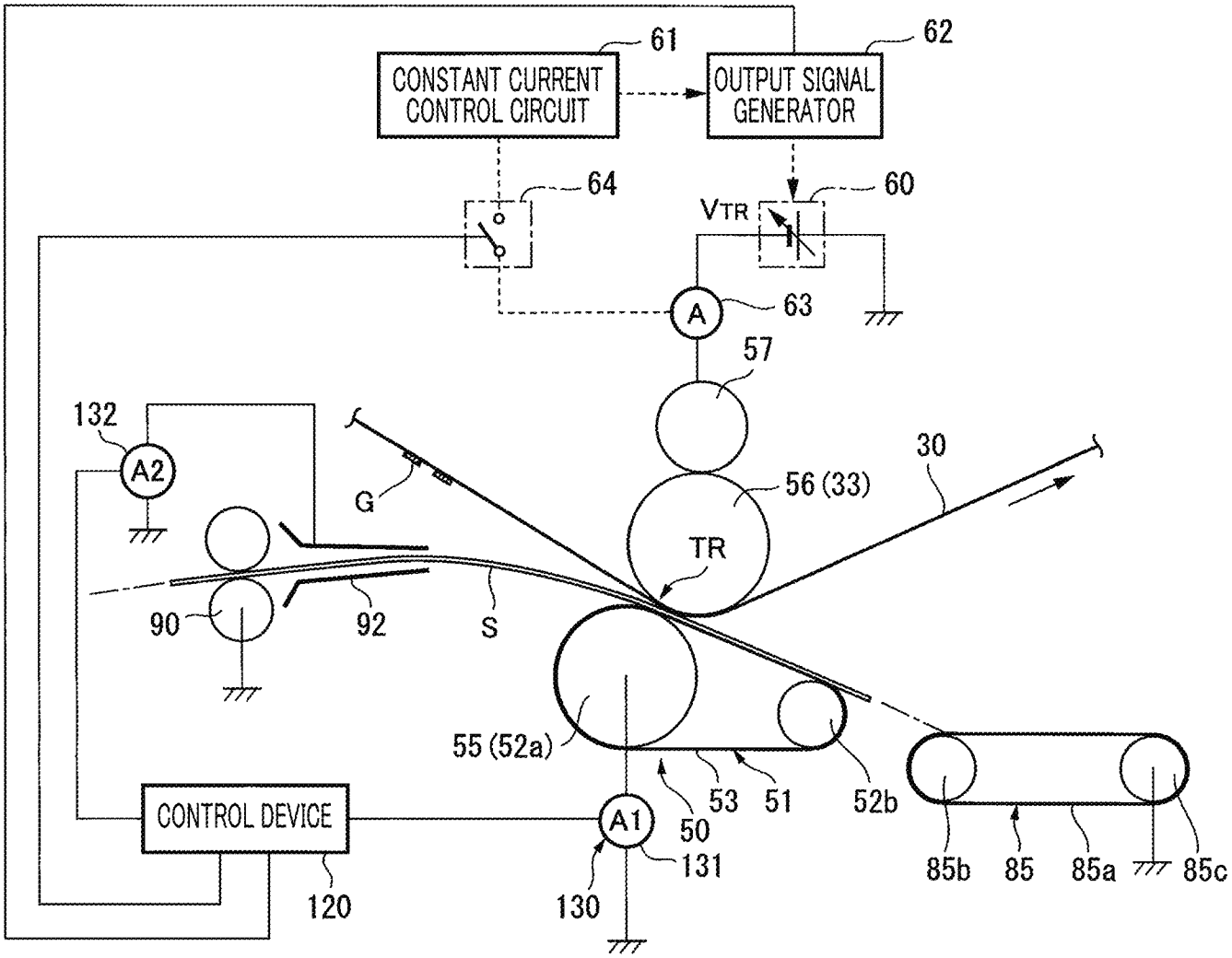
FIG. 3 is an explanatory diagram illustrating details of a configuration on a periphery of a secondary transfer unit according to Exemplary Embodiment 1.

Further, as illustrated in FIGS. 2 and 3, in the secondary transfer device (collective transfer device) 50, a stretched belt transfer module 51 in which a transfer transport belt 53 is stretched on plural (for example, two) tension rolls 52 (specifically, 52*a* and 52*b*), is disposed to be in contact with a surface of the intermediate transfer body 30. The belt transfer module 51 is retractably supported by a retraction mechanism (not illustrated), and can be brought into contact with or separated from the intermediate transfer body 30.

Here, the transfer transport belt 53 is a semiconductive belt having a volume resistivity of $10^6$ to $10^{12}$ Ω/cm using a material such as chloroprene or the like, one tension roll 52*a* is configured as an elastic transfer roll 55, this elastic transfer roll 55 is press-contacted on the intermediate transfer body 30 via the transfer transport belt 53 in the secondary transfer region (collective transfer region) TR, the tension roll 33 of the intermediate transfer body 30 is disposed oppositely as a facing roll 56 serving as a counter electrode of the elastic transfer roll 55, and a transporting path of the paper S is formed from a position of one tension roll 52*a* to a position of the other tension roll 52*b*.

In addition, in the present example, the elastic transfer roll 55 has a structure in which an elastic layer in which carbon black or the like is blended with foamed urethane rubber or EPDM is coated around a metal shaft. In the present example, all of the tension rolls 52 (52*a* and 52*b*) of the belt transfer module 51 are grounded, so that the transfer transport belt 53 is prevented from being charged. In addition, in view of detachability of the paper S at a downstream end of the transfer transport belt 53, it is effective to function the downstream tension roll 52*b* as a peeling roll having a smaller diameter than the upstream tension roll 52*a*.

Further, a transfer voltage $V_{TR}$ from a transfer power supply 60 is applied to the facing roll 56 (also used as the tension roll 33 in the present example) via a conductive power supply roll 57, and a predetermined transfer electric-field is formed between the elastic transfer roll 55 and the facing roll 56.

In the present example, the secondary transfer device 50 uses the belt transfer module 51, but the present example is not limited thereto. The present example may have a mode in which the elastic transfer roll 55 is disposed to be in direct pressure contact with the intermediate transfer body 30.

Fixing Device

As illustrated in FIG. 2, the fixing device 70 includes a driving rotatable heating fixing roll 71 which is disposed in contact with an image holding surface side of the paper S and a pressure fixing roll 72 which is disposed in pressure contact with the heating fixing roll 71 and rotates to follow the heating fixing roll 71, and passes an image held on the paper S into the transfer region between the fixing rolls 71 and 72, and heats and pressure-fixes the image.

Paper Transport System

Further, as illustrated in FIGS. 2 and 3, the paper transport system 80 includes plural (two in the present example) paper supply containers 81 and 82, and the paper S supplied from any of the paper supply containers 81 and 82 moves from a vertical transporting path 83 extending in an approximately vertical direction and reaches the secondary transfer region TR via a horizontal transporting path 84 extending in an approximately horizontal direction. After then, the paper S in which the transferred image is held reaches a fixing portion by the fixing device 70 via a transport belt 85 and is discharged to a paper exit receiver 86 provided on a side of the image forming apparatus housing 21.

Furthermore, the paper transport system 80 includes a reversible branch transporting path 87 branched downward from a portion of the horizontal transporting path 84 located on a downstream side of the fixing device 70 in a paper transport direction, the paper S reversed at the branch transporting path 87 is returned again from the vertical transporting path 83 to the horizontal transporting path 84 via a transporting path 88, and the image is transferred to a rear surface of the paper S in the secondary transfer region TR, and the paper S is discharged to the paper exit receiver 86 via the fixing device 70.

In addition, in the paper transport system 80, in addition to an aligning roll 90 which aligns the paper S and supplies the paper S to the secondary transfer region TR, an appropriate number of transport rolls 91 is provided in each of the transporting paths 83, 84, 87, and 88.

Furthermore, on an opposite side of the paper exit receiver 86 of the image forming apparatus housing 21, a manual paper feeding device 95 capable of manually feeding a piece of paper toward the horizontal transporting path 84 is provided.

Guide Chute

Further, a guide chute 92 which guides the paper S passing through the aligning roll 90 to the secondary transfer region TR is provided on an inlet side of the secondary transfer region TR of the horizontal transporting path 84. In the present example, the guide chute 92 arranges a pair of metal plates such as SUS in a predetermined inclined posture, and restricts a rush posture of the paper S rushing into the secondary transfer region TR, and is directly grounded. In the present example, one guide chute 92 is illustrated between the aligning roll 90 and the secondary transfer region TR, but it is not necessary to be one, and plural guide chutes 92 may be provided.

Contact Member with Paper Located Before and after Secondary Transfer Region

In the present exemplary embodiment, as a contact member with the paper S located before and after the secondary transfer region TR, as illustrated in FIGS. 2 and 3, the guide chute 92 and the aligning roll 90 are provided on the inlet side of the secondary transfer region TR, and the transport belt 85 is provided on an outlet side of the secondary transfer region TR.

In the present example, the aligning roll 90 is formed of a metal roll member, the guide chute 92 is formed of a metal chute member, and both of the aligning roll 90 and the guide chute 92 are directly grounded.

In the present example, although both of the aligning roll 90 and the guide chute 92 are directly grounded, the present example is not limited thereto. A resistance grounding method of grounding via a resistance may be adopted. However, as the resistance used in the resistance grounding method, a resistance lower than a resistance value (for example, a volume resistivity) of the highest resistance element (for example, the elastic transfer roll 55) may be selected among components of the belt transfer module 51.

In addition, in the present example, the transport belt 85 stretches a belt member 85*a* made of, for example, conductive rubber with a pair of tension rolls 85*b* and 85*c*, and at least one tension roll of the tension rolls 85*b* and 85*c* is configured to include a metal roll, a conductive resin, or a combination thereof, and a core metal is directly grounded.

Further, in the present exemplary embodiment, a paper transporting path length between the guide chute 92 and the transport belt 85, which are contact members of the paper S located closest to the inlet side and the outlet side across the secondary transfer region TR, may be appropriately selected. For example, in a case where the paper transporting path length described above is set shorter than a length of a piece of paper having an usable minimum size in a transport direction, at least in the transport process in which the paper S passes through the secondary transfer region TR, an operation in which the paper S is disposed in a state of being straddled between the secondary transfer region TR and the guide chute 92 or the transport belt 85 is illustrated, but in the present exemplary embodiment, while the paper S passes through the secondary transfer region TR, the paper S may not be disposed in the state of being straddled with the guide chute 92 or the transport belt 85.

Paper Type

An example of the paper S which can be used in the present example widely includes a range of paper with a low surface resistance to a high resistance.

In recent years, a demand for printing on special paper other than plain paper, such as colored paper and fancy paper, is increased, and in these, resistances are not management characteristics and a variation is relatively large. Specifically, carbon black is often used to adjust blackness in black paper, and in some cases, a resistance value is extremely low depending on a product brand and a lot even in a case where a basis weight as a standard of a paper type table is the same. As described above, in the case of using the paper S having a large variation in a resistance even with the same basis weight, as described below, a transfer current path differs depending on whether the paper S has a low resistance or a non-low resistance. Accordingly, there is a concern that a transfer current necessary for the secondary transfer region TR of the secondary transfer device 50 may be insufficient, for example.

Relationship Between Paper Type and Transfer Current Path

Non-Low Resistance Paper

Figure 4A:
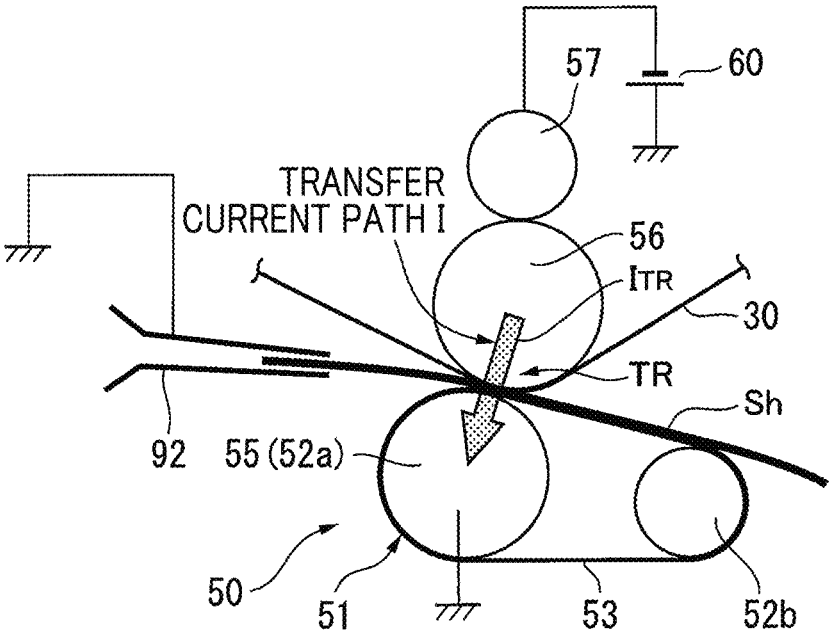
FIG. 4A is an explanatory diagram illustrating a transfer current path flowing in a case where a piece of paper other than a piece of low-resistance paper is used in the image forming apparatus according to Exemplary Embodiment 1.

Assuming that a piece of non-low resistance paper Sh rushes into the secondary transfer region TR, as illustrated in FIG. 4A, the non-low resistance paper Sh reaches the secondary transfer region TR via the guide chute 92. The image G on the intermediate transfer body 30 is transferred to the non-low resistance paper Sh in the secondary transfer region TR. At this time, even in a case where the non-low resistance paper Sh is in contact with the guide chute 92 while the non-low resistance paper Sh passes through the secondary transfer region TR, since a surface resistance of the non-low resistance paper Sh is high to some extent, a part of a transfer current $I_{TR}$ in the secondary transfer region TR does not leak through a conduction path leading to a ground of the guide chute 92 with the non-low resistance paper Sh as the conduction path. Therefore, the transfer current $I_{TR}$ in the secondary transfer region TR flows through a side of the facing roll 56, the intermediate transfer body 30, the non-low resistance paper Sh, and the belt transfer module 51. A system resistance of a transfer current path I in this case is a total of the facing roll 56, the intermediate transfer body 30, the non-low resistance paper Sh, and the belt transfer module 51.

Low Resistance Paper

Figure 4B:
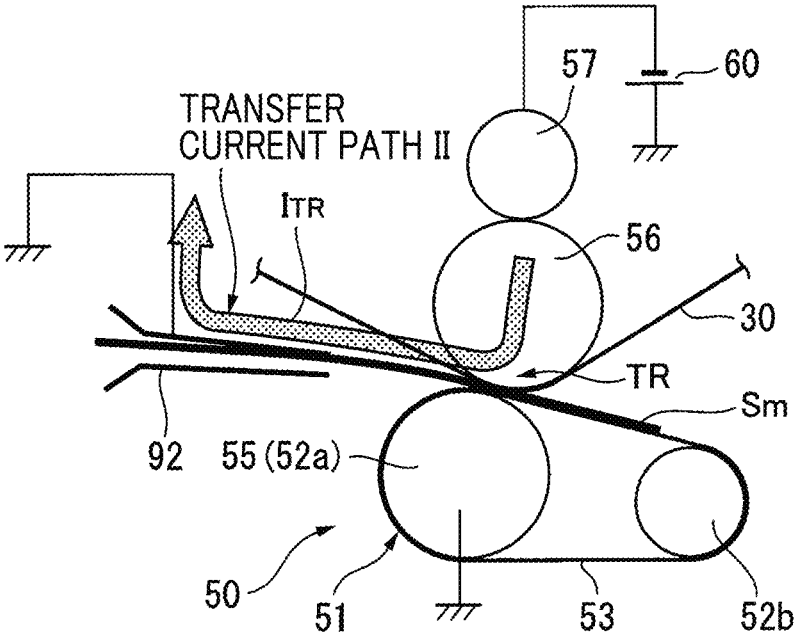
FIG. 4B is an explanatory diagram illustrating a transfer current path flowing in a case where the low-resistance paper is used by the image forming apparatus.

On the other hand, assuming that a piece of low resistance paper Sm such as metallic paper or low-resistance black paper rushes into the secondary transfer region TR, as illustrated in FIG. 4B, low resistance paper Sm reaches the secondary transfer region TR via the guide chute 92. Therefore, in order to keep the low resistance paper Sm passing through the secondary transfer region TR in contact with the grounded guide chute 92, after passing through the facing roll 56 and the intermediate transfer body 30, the transfer current $I_{TR}$ in the secondary transfer region TR flows from the guide chute 92 to the ground through the low resistance paper Sm as a conduction path. Since resistance values of the guide chute 92 and the low resistance paper Sm are low, a system resistance of a transfer current path II in this case is mostly a sum of the facing roll 56 and the intermediate transfer body 30.

Configuration Example of Transfer Power Supply

As a transfer control method by the transfer power supply 60, there are a constant voltage control method and a constant current control method. The constant voltage control method is robust (strength against disturbance) to an image density fluctuation but weak to paper type fluctuation. The constant current control method is robust to the paper type fluctuation but weak to the image density fluctuation. Since a paper type can be handled by preparing a transfer voltage table in advance, in general, the constant voltage control system is adopted, in many cases.

In the present example, the transfer power supply 60 is configured to enable to select either constant current control or constant voltage control. Specifically, as illustrated in FIG. 3, the transfer voltage $V_{TR}$ is variably set by the transfer power supply 60 based on a signal from an output signal generator 62, and a constant current control circuit 61 is connected to the output signal generator 62. In addition, an ammeter 63 for feedback is connected in series between the transfer power supply 60 and the power supply roll 57, a conduction path for feedback is provided between the ammeter 63 and the constant current control circuit 61, a selection switch 64 is provided in a middle of the conduction path for feedback, and whether to perform constant current control based on feedback is selected by an on/off operation of the selection switch 64. In a case of a condition that the selection switch 64 is turned on, a current value monitored by the ammeter 63 is fed back to the output signal generator 62 via the constant current control circuit 61, and the transfer voltage $V_{TR}$ of the transfer power supply 60 is variably set so that the transfer current $I_{TR}$ in the secondary transfer region TR becomes a constant current.

Figure 5A:
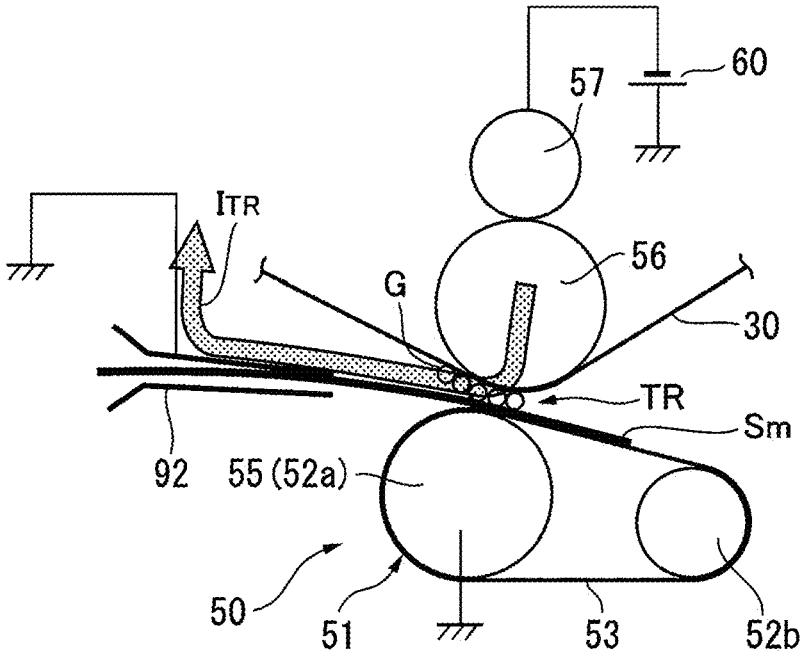
FIG. 5A is an explanatory diagram illustrating that a transfer operation by the transfer current path illustrated in FIG. 4B can be executed.

In the present example, as illustrated in FIG. 5A, since the transfer power supply 60 is connected to the facing roll 56 side, the transfer current $I_{TR}$ flows from a contact member such as the guide chute 92 or the like to the ground and from the intermediate transfer body 30 via the low resistance paper Sm. Since a transfer electric-field is formed between the intermediate transfer body 30 and the low resistance paper Sm, the image G by a toner on the intermediate transfer body 30 is transferred to the low resistance paper Sm side.

Figure 5B:
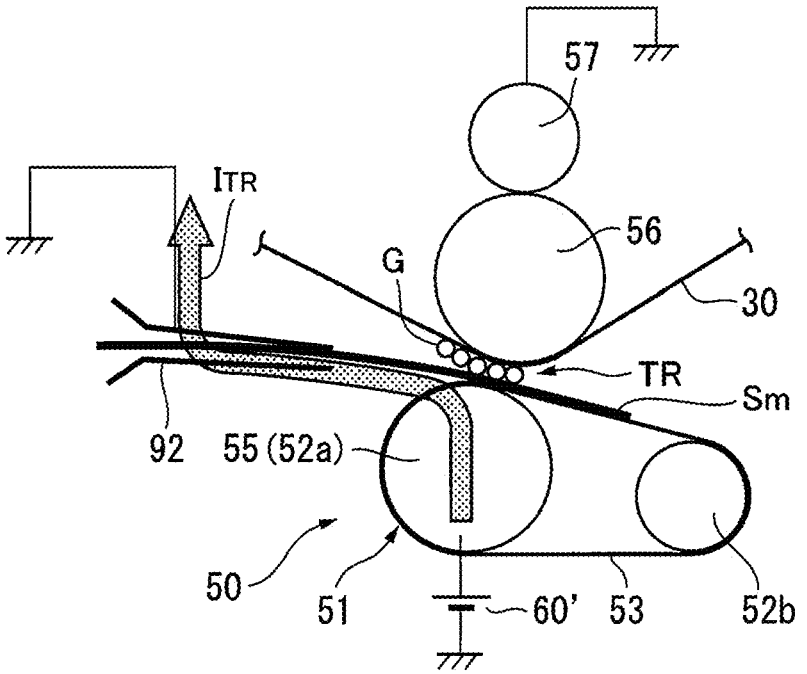
FIG. 5B is an explanatory diagram illustrating that a transfer operation by a secondary transfer unit according to a comparative embodiment cannot be executed.

However, as illustrated in FIG. 5B, in a case where a transfer power supply 60' is connected to the belt transfer module 51 side, the transfer current $I_{TR}$ flows from the contact member such as the guide chute 92 or the like to the ground and from the intermediate transfer body 30 via the low resistance paper Sm. Since the transfer electric-field is not applied between the intermediate transfer body 30 and the low resistance paper Sm, the image G by the toner on the intermediate transfer body 30 is not transferred to the low resistance paper Sm side. That is, the transfer power supply 60 needs to be connected to the facing roll 56 side so as to apply the transfer voltage V m.

System Resistance Detection Circuit

In the present exemplary embodiment, as illustrated in FIGS. 4A and 4B, in view of the fact that the transfer current path differs depending on the paper type, a system resistance detection circuit 130 (see FIG. 3) which detects a system resistance of the transfer current path I (see FIG. 4A) and the transfer current path II (see FIG. 4B) in a state in which the paper S reaches the secondary transfer region TR is provided.

In the present example, as illustrated in FIGS. 3, 4A, and 4B, the system resistance detection circuit 130 includes a first ammeter 131 connected in series between the elastic transfer roll 55 of the belt transfer module 51 and the ground and a second ammeter 132 connected in series between the guide chute 92 and the ground. When the front end portion of the paper S in the transport direction reaches the secondary transfer region TR and the paper S is placed between the secondary transfer region TR and the guide chute 92, a voltage for detecting the system resistance is applied to the power supply roll 57 from the transfer power supply 60 and the value of the current flowing through the first ammeter 131 and the second ammeter 132 is measured. Here, a current value $I_{A1}$ measured by the first ammeter 131 depends on a system resistance of the transfer current path I (corresponding to a path to the facing roll 56, the intermediate transfer body 30, the paper S, and the belt transfer module 51). On the other hand, the current value $I_{A2}$ measured by the second ammeter 132 depends on a system resistance of the transfer current path II (corresponding to a path to the facing roll 56, the intermediate transfer body 30, the paper S, and the guide chute 92).

Image Forming Mode

Figure 6A:
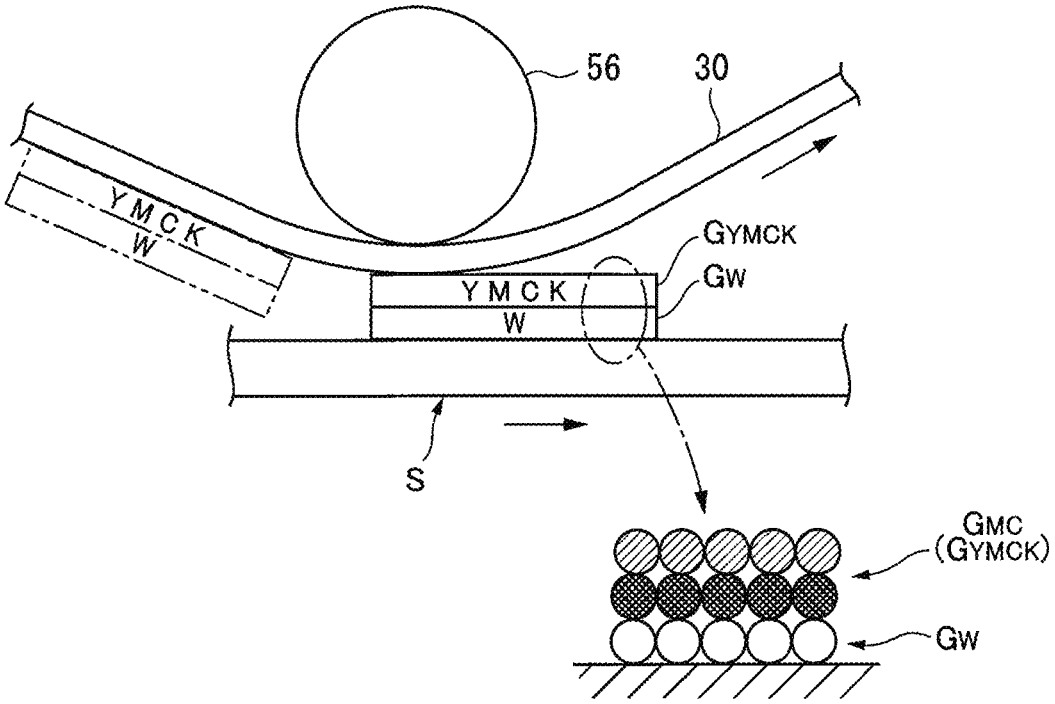
FIG. 6A is an explanatory diagram illustrating an example of forming a multicolor image on a piece of paper by the image forming apparatus according to Exemplary Embodiment 1.
Figure 6B:
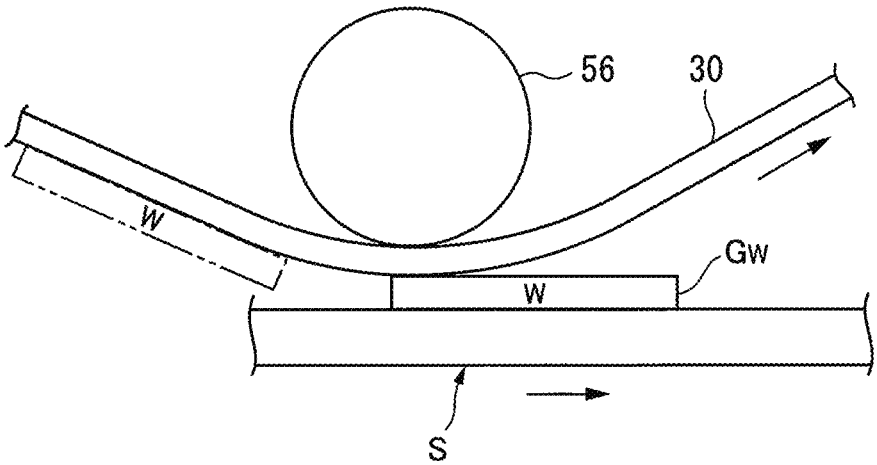
FIG. 6B is an explanatory diagram illustrating an example of forming a monochromatic image on a piece of paper by the image forming apparatus.

The image forming apparatus of the present example uses a multicolor mode illustrated in FIG. 6A and a monochrome mode illustrated in FIG. 6B as image forming modes.

In the multicolor mode, for example, in a case where black paper is used as the paper S, as illustrated in FIG. 6A, a color image $G_{YMCK}$ by YMCK using all or a part of the image forming units 22*b* to 22*e* illustrated in FIG. 2, for example, a color image $G_{MC}$ by MC using the image forming units 22*c* and 22*d* are formed on the intermediate transfer body 30, a white image Gw as a single color image by white W using the image forming unit 22*f* illustrated in FIG. 2 is formed on this color image $G_{MC}$ ($G_{YMCK}$), and the white image Gw and the color image $G_{MC}$ ($G_{YMCK}$) are collectively transferred onto the black paper as the paper S in the secondary transfer region TR.

On the other hand, in the monochromatic mode, for example, in a case where black paper is used as the paper S, as illustrated in FIG. 6B, for example, a white image Gw is formed as a single color image by white W using the image forming unit 22*f* illustrated in FIG. 2, and the white image Gw is transferred onto black paper as the paper S in the secondary transfer region TR. In addition, instead of the white image Gw, for example, a monochromatic image may be formed by any color toner of YMC.

Setting Method of Secondary Transfer Current

In the present exemplary embodiment, the secondary transfer device 50 needs to set the transfer current $I_{TR}$ necessary for the secondary transfer region TR so as to appropriately perform a transfer operation in the secondary transfer region TR even in a case where any of the constant voltage control or the constant current control is adopted.

Figure 7:
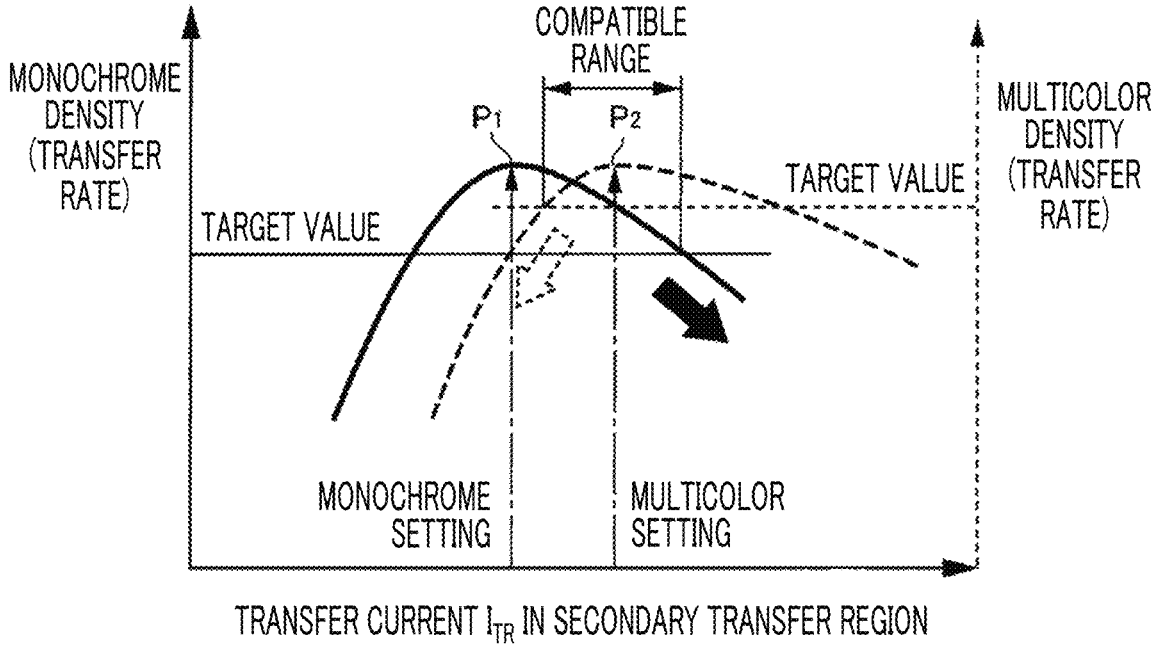
FIG. 7 is an explanatory diagram illustrating a method of setting a secondary transfer current in a case of performing constant current control.

As illustrated in FIGS. 6A and 6B, in a case where an imaging mode is the multicolor mode or the monochromatic mode, since layer thicknesses of transfer target images (a multicolor image [for example, the color image $G_{MC}$ ($G_{YMCK}$)+the white image Gw], a monochromatic image [for example, the white image Gw]) are different from each other, a relationship between the transfer current $I_{TR}$ in the secondary transfer region TR and a transfer rate (the multicolor image and a density transfer rate of the monochromatic image) is examined, and the result illustrated in FIG. 7 is obtained.

Referring to FIG. 7, the monochromatic image (the white image Gw) shows a curvilinear change tendency in which as the transfer current $I_{TR}$ increases, the transfer rate gradually increases and then gradually decreases after a peak point P1. The transfer rate is equal to or larger than a target value within a predetermined range across the peak point P1. On the other hand, also in a case of the multicolor image (the color image $G_{MC}$ ($G_{YMCK}$)+the white image Gw), a relationship between the transfer current $I_{TR}$ and the transfer ratio indicates a change tendency similar to that in the case of the monochromatic image (the white image Gw). As compared with the change curve in the case of the white image (the monochromatic image) Gw, a value of the transfer current $I_{TR}$ is shifted higher as a whole, and the value of the transfer current $I_{TR}$ is higher at a position of a peak point P2 as compared with the peak point P1.

For any image forming mode, from the viewpoint of obtaining the transfer rate equal to or higher than the target value, the value of the transfer current $I_{TR}$ may be set within a compatible range illustrated in FIG. 7. Meanwhile, as described below, the value of the transfer current $I_{TR}$ may be made different according to the image forming mode.

In a case of the constant voltage control, the first system resistance is calculated from the current value $I_{A1}$ of the first ammeter 131, and the secondary transfer voltage is set based on the transfer current $I_{TR}$ described above and the first system resistance.

Driving Control System of Image Forming Apparatus

In the present exemplary embodiment, as illustrated in FIG. 3, a reference numeral 120 is a control device which controls an image forming process of the image forming apparatus, and this control device 120 is a microcomputer including a CPU, a ROM, a RAM, and an input/output interface. The control device 120 obtains various input signals of various sensor signals including a switch signal of a start switch (not illustrated), a mode selection switch for selecting an image forming mode, or the like via the input/output interface or a detection signal from the system resistance detection circuit 130, causes the CPU to execute an image forming control program (see FIG. 8) stored in advance in the ROM, and transmits a control signal to each driving control target (the image forming unit 22 (22*a* to 22*f*), the transfer power supply 60, or the like).

Operation of Image Forming Apparatus

Figure 8:
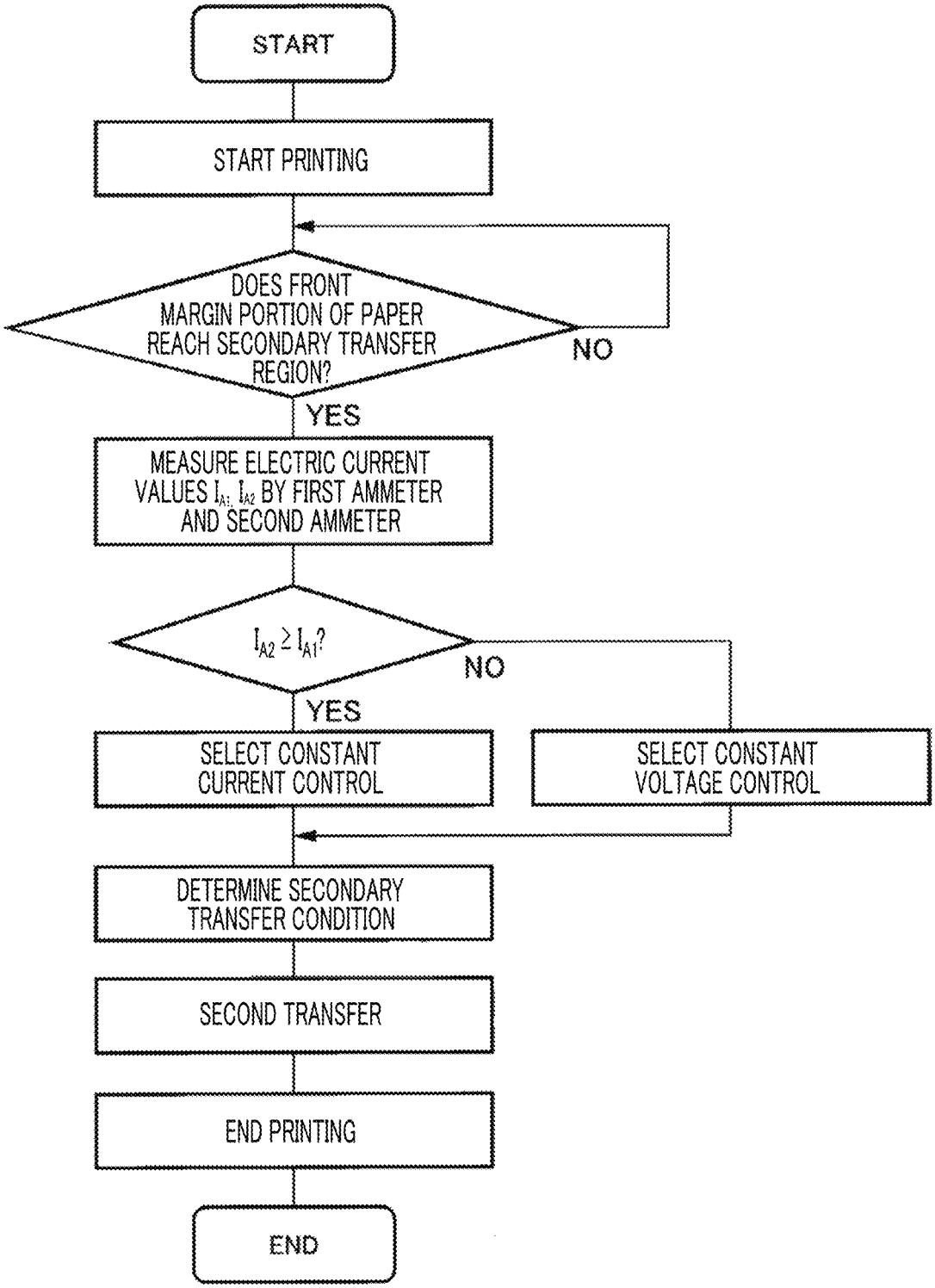
FIG. 8 is a flowchart illustrating a paper type image forming sequence used in the image forming apparatus according to Exemplary Embodiment 1.

Next, in the image forming apparatus illustrated in FIGS. 2 and 3, assuming that the pieces of paper S having different types are mixed and used, as illustrated in FIG. 8, printing (the image forming process) by the image forming apparatus is started by turning on the start switch (not illustrated).

At this time, the paper S is supplied from one of the paper supply containers 81 and 82 or the manual paper feeding device 95, and is transported toward the secondary transfer region TR via a predetermined transporting path.

In the present example, the system resistance detection circuit 130 detects a system resistance at a timing when the front end portion of the paper S reaches the secondary transfer region TR.

Figure 9A:
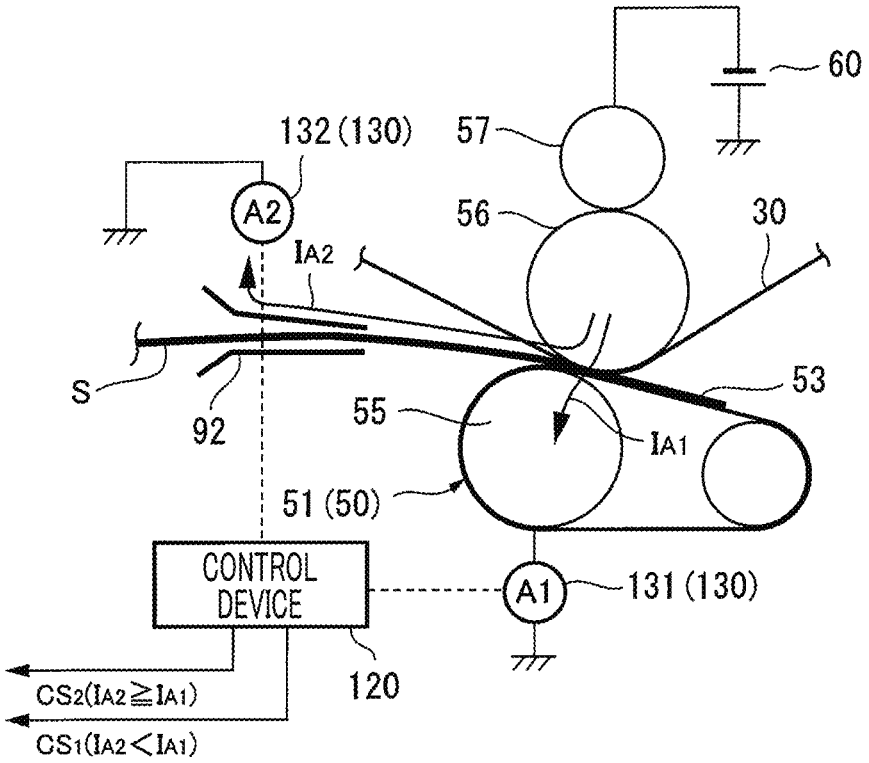
FIG. 9A is an explanatory diagram schematically illustrating a process of switching constant voltage control or constant current control as a transfer operation of the secondary transfer unit in the paper type image forming sequence in FIG. 8.
Figure 9B:
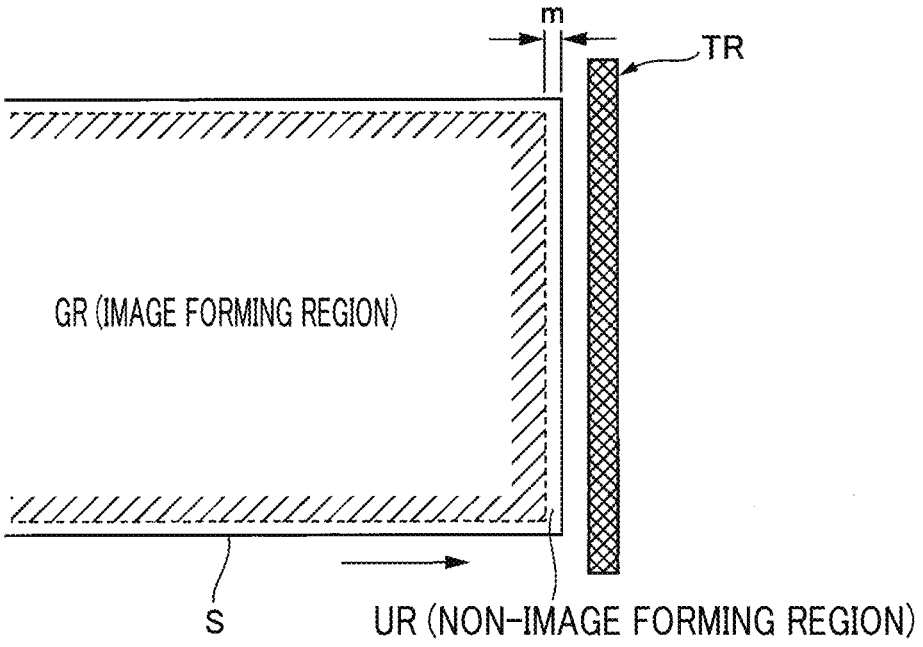
FIG. 9B is an explanatory diagram illustrating a measurement time of an electric current value by a first ammeter and a second ammeter.

As illustrated in FIG. 9B, the front end portion of the paper S is a non-image forming region UR (corresponding to a tip margin portion) located on the front end side of the paper S in the transport direction in a region other than an image forming region GR of the paper S. The timing A when the front end portion of the paper S reaches the secondary transfer region TR is determined, for example, by counting the time when the front end of the paper S reaches the secondary transfer region TR at a predetermined transporting speed after passing through the position sensor installed in the middle of the transporting path of the paper S.

Detection Process of System Resistance

In the present example, as illustrated in FIG. 9A, a detection process of a system resistance is performed in a state in which the front end portion of the paper S reaches the secondary transfer region TR and is disposed to be straddled between the secondary transfer region TR and the guide chute 92. Whether or not $I_{A2} \geq I_{A1}$ is determined based on a result of measuring the current values $I_{A1}$ and $I_{A2}$ of the first ammeter 131 and the second ammeter 132 by the control device 120.

In a case where the control device 120 determines that $I_{A2} < I_{A1}$, constant voltage control is selected as a transfer operation for the secondary transfer region TR, in a case where it is determined that $I_{A2} \geq I_{A1}$, constant current control is selected as the transfer operation for the secondary transfer region TR, and respectively transmits control signals $CS_1$ and $CS_2$.

Constant Voltage Control

Constant voltage control is performed under a condition of $I_{A2} < I_{A1}$. The condition of $I_{A2} < I_{A1}$ means that the current value $I_{A1}$ of the first ammeter 131 flows more than the current value $I_{A2}$ of the second ammeter 132, and the transfer current $I_{TR}$ flows via the transfer current path I illustrated in FIG. 4A. This execution condition corresponds to the fact that the paper S to be used is the non-low resistance paper Sh, and means that it is not apprehended that a part of the transfer current $I_{TR}$ in the secondary transfer region TR leaks along a surface of the paper S via the guide chute 92.

Figure 10A:
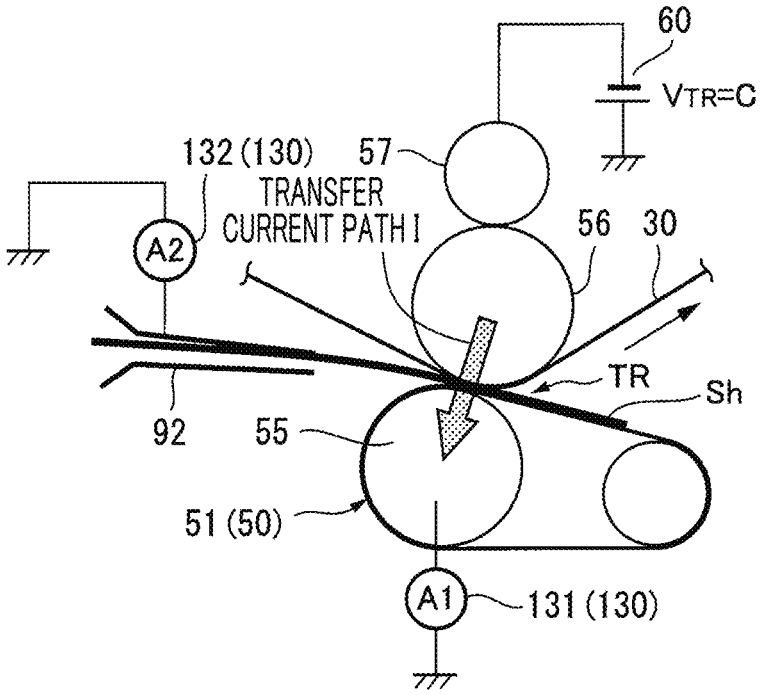
FIG. 10A is an explanatory diagram schematically illustrating a transfer operation of the secondary transfer unit by constant voltage control in the paper type image forming sequence in FIG. 8.

Therefore, in a case where the paper S to be used is the non-low resistance paper Sh, as illustrated in FIG. 10A, the transfer voltage $V_{TR}$ of the transfer power supply 60 is set to a predetermined constant voltage by the control signal $CS_1$ illustrated in FIG. 9A, and the constant voltage control is performed on the secondary transfer region TR. At this time, while the non-low resistance paper Sh passes through the secondary transfer region TR, a rear end of the non-low resistance paper Sh is in contact with the guide chute 92 at first, but the rear end passes through the guide chute 92 in the middle. Since the transfer operation by the transfer current path I is continuously performed even in a case where the non-low resistance paper Sh passes through the guide chute 92, there is no concern that the condition for transfer in the secondary transfer region TR may change while the non-low resistance paper Sh passes through the secondary transfer region TR.

Constant Current Control

Constant current control is performed under a condition of $I_{A2} \geq I_{A1}$. The condition of $I_{A2} \geq I_{A1}$ means that the current value $I_{A2}$ of the second ammeter 132 flows equal to or more than the current value $I_{A1}$ of the first ammeter 131, and the transfer current $I_{TR}$ flows via the transfer current path II illustrated in FIG. 4B. This execution condition corresponds to the fact that the paper S to be used is the low resistance paper Sm, and means that most of the transfer current $I_{TR}$ in the secondary transfer region TR reaches the ground along the surface of the paper S via the guide chute 92.

Figure 10B:
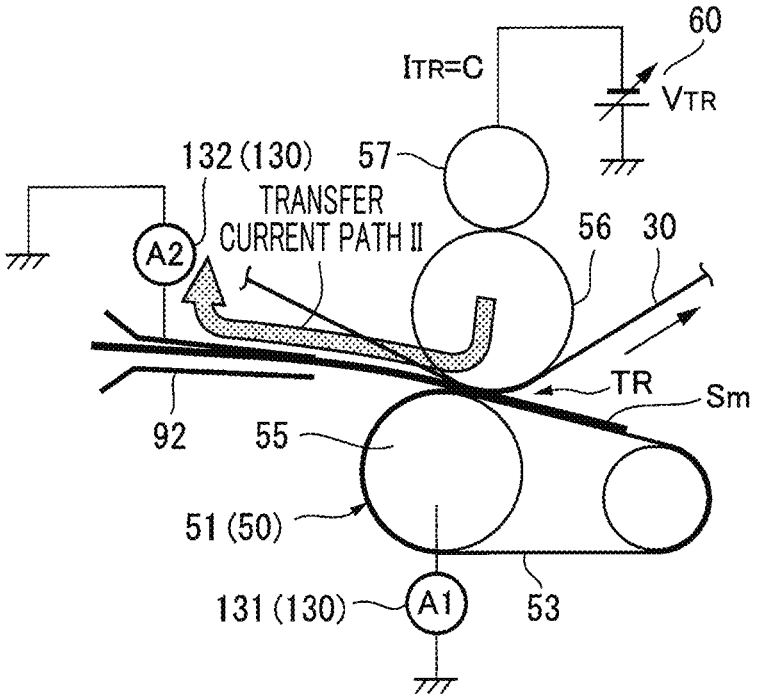
FIG. 10B is an explanatory diagram schematically illustrating a transfer operation of the secondary transfer unit by constant current control in the paper type image forming sequence.

Therefore, in a case where the paper S to be used is the low resistance paper Sm, as illustrated in FIG. 10B, the constant current control circuit 61 operates by turning on the selection switch 64 of the transfer power supply 60 by the control signal $CS_2$ illustrated in FIG. 9A, and the constant current control is performed on the secondary transfer region TR. At this time, while the low resistance paper Sm passes through the secondary transfer region TR, a rear end of the low resistance paper Sm is in contact with the guide chute 92 at first, but the rear end passes through the guide chute 92 in the middle. Although the transfer operation by the transfer current path II is performed while the low resistance paper Sm is disposed to be straddled between the secondary transfer region TR and the guide chute 92, when the rear end of the low resistance paper Sm passes through the guide chute 92, the transfer operation by the transfer current path I is performed instead of the transfer operation by the transfer current path II. However, in the present example, the constant current control is performed on the secondary transfer region TR. Therefore, even in a case where the transfer current path is switched from I to II and the system resistance through which the transfer current $I_{TR}$ flows changes, the transfer current $I_{TR}$ flowing through the secondary transfer region TR is kept constant, and the condition for transfer in the secondary transfer region TR does not change while the low resistance paper Sm passes through the secondary transfer region TR. Therefore, as described below, for example, in a case where the constant voltage control method is adopted, there is no concern that a density level difference may occur in the middle of the image transferred to the low resistance paper Sm.

Exemplary Embodiment 2

Figure 11:
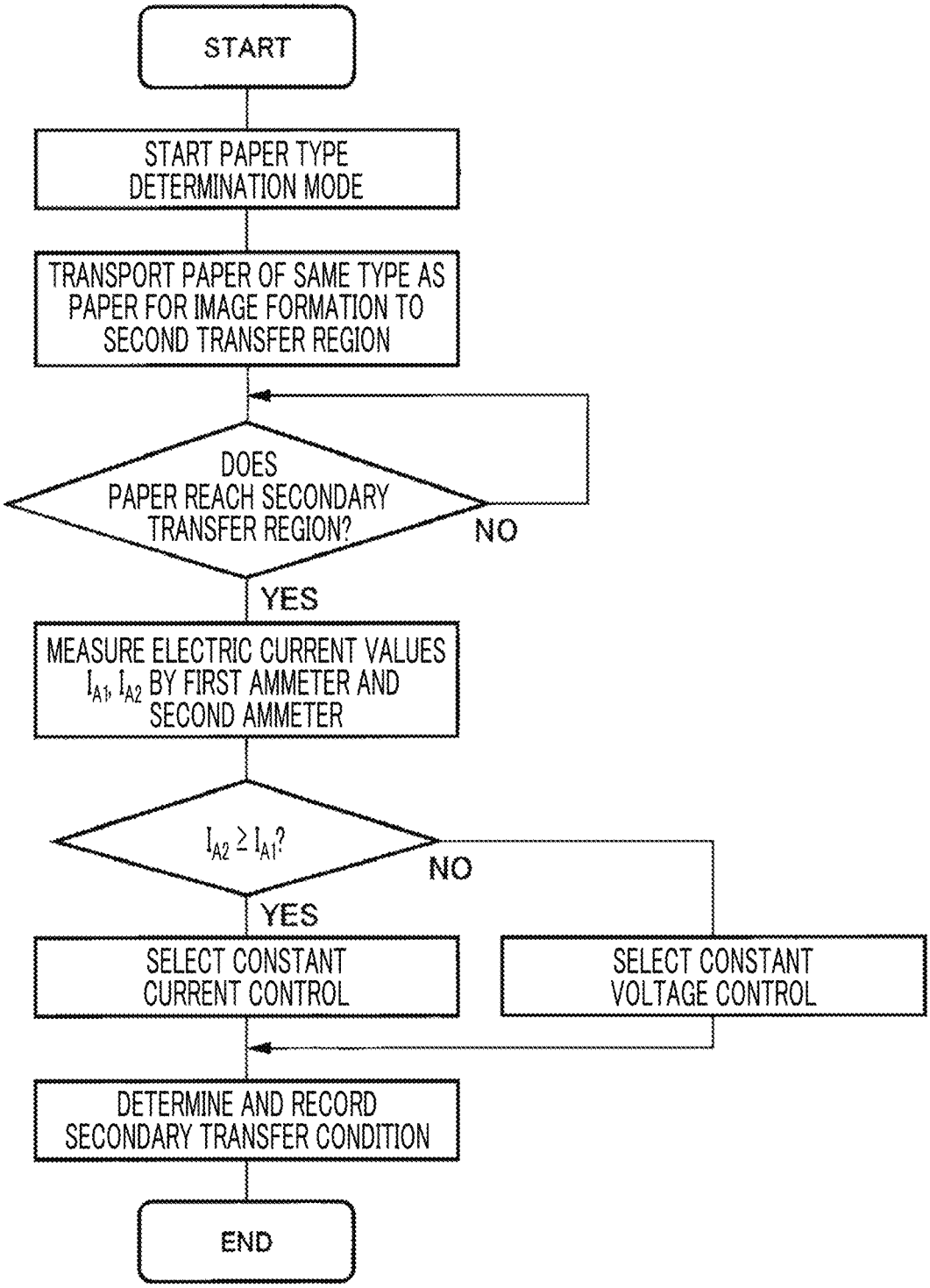
FIG. 11 is a flowchart illustrating a paper type image forming sequence used in an image forming apparatus according to Exemplary Embodiment 2.

FIG. 11 is a flowchart illustrating a paper type image forming sequence for the image forming apparatus according to Exemplary Embodiment 2.

In FIG. 11, a basic configuration of the image forming apparatus is approximately the same as that of Exemplary Embodiment 1, but a detection process of a system resistance in the secondary transfer region TR in the paper type image forming sequence is different from Exemplary Embodiment 1.

That is, in the present exemplary embodiment, for example, a mode selection switch (not illustrated) for selecting a paper type determination mode is provided in an operation panel (not illustrated), and a user turns on the mode selection switch so that the paper type determination mode is started.

In the present example, the paper type determination mode is executed at a non-image forming mode timing other than the image forming mode in which printing (the image forming process) by the image forming apparatus 20 is started. A paper for detection of the same type as the paper S for image formation, for example, a piece of paper from the paper supply containers 81 and 82 in which the paper S for image formation is stored in advance, or a manual feed paper separately set in the manual paper feeding device 95 is transported to the secondary transfer region TR, a voltage for system resistance detection is applied to the power supply roll 57 by using the transfer power supply 60 when the paper for detection reaches the secondary transfer region TR and is disposed to be straddled between the secondary transfer region TR and the guide chute 92, and the current values $I_{A1}$ and $I_{A2}$ flowing through the first ammeter 131 and the second ammeter 132 are measured. In the present example, since the image forming process is not performed on the paper for detection, unlike Exemplary Embodiment 1, a nip position of the paper for detection in the secondary transfer region TR may not be the front end portion (the non-image forming region UR) in the transport direction.

The control device 120 obtains the current value $I_{A1}$ measured by the first ammeter 131 and the current value $I_{A2}$ measured by the second ammeter 132, determines whether or not a condition of $I_{A2} \geq I_{A1}$ is satisfied. In a case where it is determined that $I_{A2} < I_{A1}$, the constant voltage control is selected as the transfer operation on the secondary transfer region TR, and in a case where it is determined that $I_{A2} \geq I_{A1}$, the constant current control is selected as the transfer operation on the secondary transfer region TR. According to this, the control device 120 determines and records a secondary transfer condition (the transfer voltage $V_{TR}$ or the transfer current $I_{TR}$) in the RAM.

Thereafter, in a case where printing (the image forming processing) by the image forming apparatus is started by turning on the start switch, the control device 120 performs the constant voltage control or the constant current control on the paper S for image formation by using the secondary transfer condition determined and recorded in the paper type determination mode.

Exemplary Embodiment 3

Figure 12:
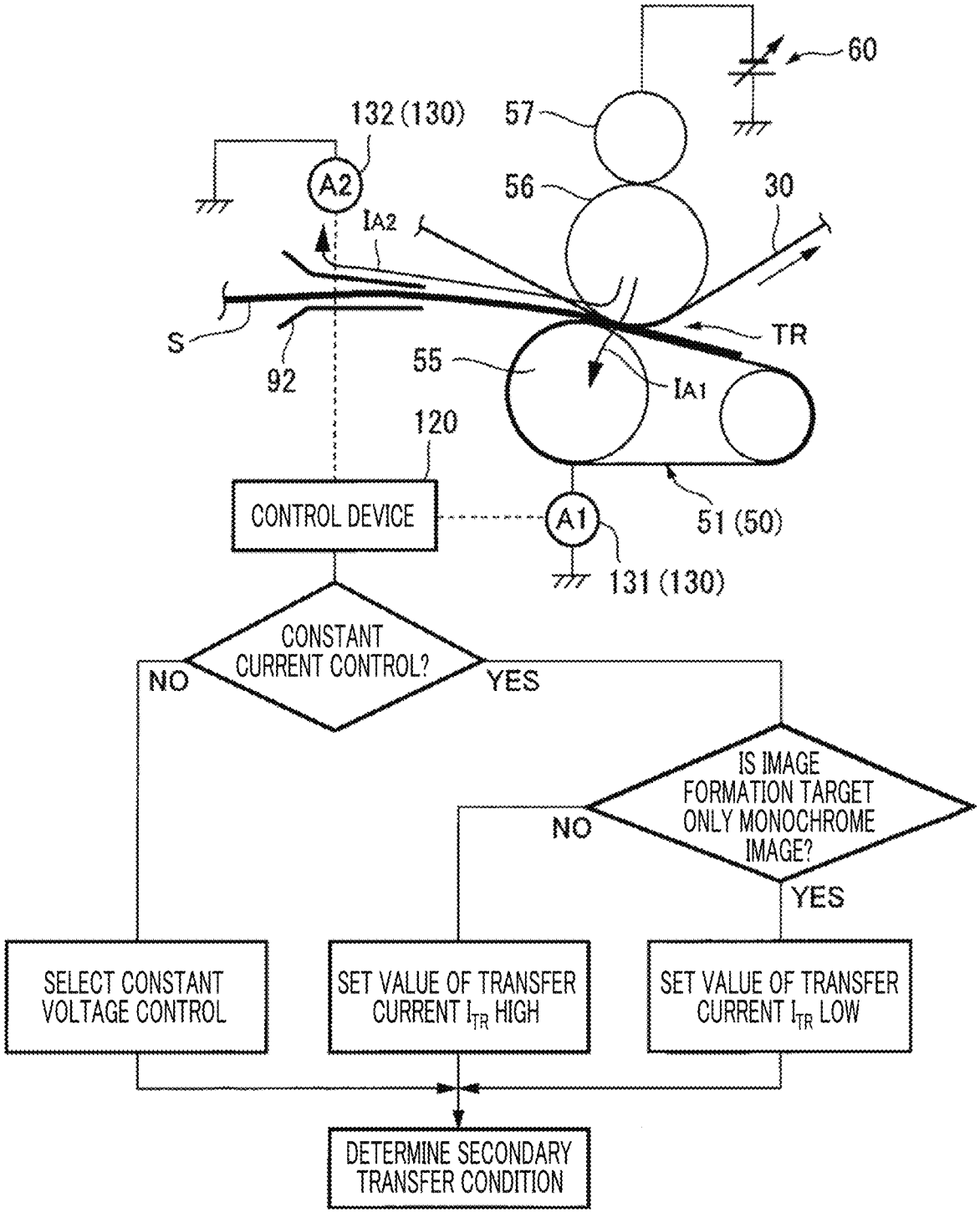
FIG. 12 is an explanatory diagram illustrating a paper type image forming sequence used in an image forming apparatus according to Exemplary Embodiment 3.

FIG. 12 is an explanatory diagram illustrating a basic portion of a paper type image forming sequence of the image forming apparatus according to Exemplary Embodiment 3.

In FIG. 12, a basic configuration of the paper type image forming sequence is approximately the same as that of Exemplary Embodiment 1, but unlike Exemplary Embodiment 1, in a case where the constant current control is selected, a setting value of the transfer current $I_{TR}$ is made different in consideration of a type of an image formation target.

Specifically, in a case where the image formation target is only a monochromatic image (for example, the white color image Gw), a setting value of the transfer current $I_{TR}$ is set lower as compared with a case where a multicolor image is included. In a case where the image formation target includes the multicolor image (for example, the color image $G_{MC}$ ($G_{YMCK}$)+the white image Gw) (only the multicolor image or a combination of the multicolor image and the monochromatic image), the setting value of the transfer current $I_{TR}$ is set higher as compared with a case of only the monochromatic image. In particular, as illustrated in FIG. 7, a transfer rate of the monochromatic image or the multicolor image depends on a value of the transfer current $I_{TR}$. Since the peak point P1 of the transfer rate of the monochromatic image is shifted to the lower side in which the transfer current $I_{TR}$ is lower than at the peak point P2 of the multicolor image, in a case where the transfer current $I_{TR}$ is set low (for example, set near the peak point P1 of the transfer rate) when printing the monochromatic image (the image forming process), it is possible to obtain a transfer rate closer to an optimal transfer rate.

Exemplary Embodiment 3-1

Figure 13:
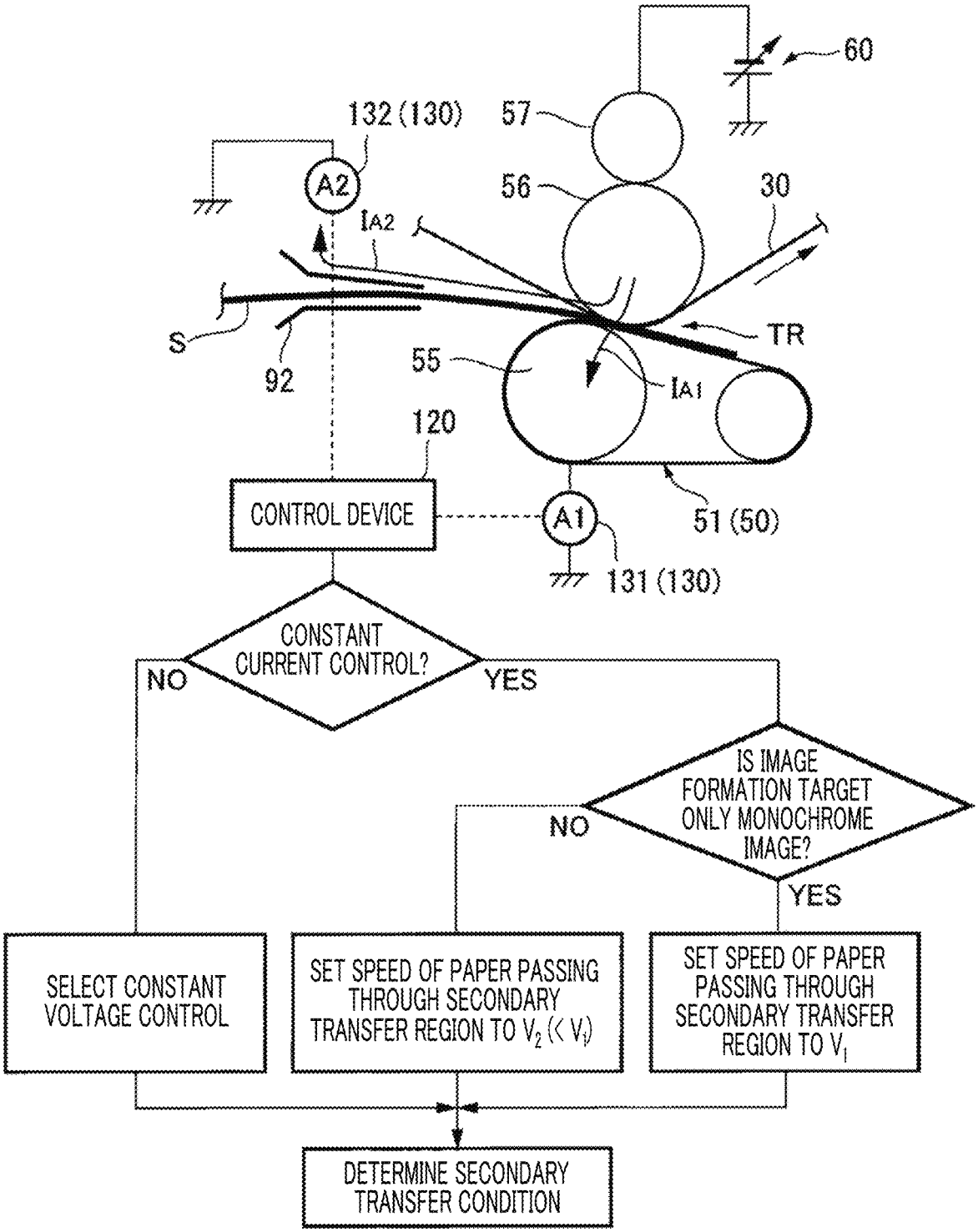
FIG. 13 is an explanatory diagram illustrating a paper type image forming sequence used in Exemplary Embodiment 3-1 of the image forming apparatus according to Exemplary Embodiment 3.

In the present exemplary embodiment, in a case where the constant current control is selected, the setting value of the transfer current $I_{TR}$ is made different in consideration of the type of the image to be formed and the transfer rate more appropriate to the type of the image is secured, but the present exemplary embodiment is not limited thereto. For example, as in Exemplary Embodiment 3-1 illustrated in FIG. 13, it is also possible to make a speed of the paper passing through the secondary transfer region TR different in consideration of the image to be formed.

Specifically, in a case where the image formation target is only a monochromatic image (for example, the white color image Gw), a speed of the paper passing through the secondary transfer region TR is set to a speed $v_1$ faster as compared with a case where a multicolor image is included. In a case where the image formation target includes the multicolor image (for example, the color image $G_{MC}$ ($G_{YMCK}$)+the white image Gw), the speed of the paper passing through the secondary transfer region TR is set to a speed $v_2$ ($<v_1$) lower than that in the case of only the monochromatic image.

In the present exemplary embodiment, in a case where the constant current control is selected, the transfer current $I_{TR}$ is shared regardless of the type of image to be formed. In a case where the multicolor image is included, the speed of the paper is set to the speed $v_2$ slower than the speed $v_1$ for the monochromatic image, so that it is possible to lengthen a transfer operation time per unit length in the secondary transfer region TR and it is effective to enhance the transfer rate of the multicolor image.

EXAMPLES

Example 1

The present example is embodied by applying the image forming apparatus according to Exemplary Embodiment 1 to Color 1000 Press manufactured by Fuji Xerox Co., Ltd.

Evaluation environment: 20° C./10%, process speed: 524 mm/s, toner: specific gravity 1.1 and average particle diameter 4.7 μm for YMC, specific gravity 1.2 and average particle diameter 4.7 μm for K, specific gravity 1.6 and average particle size 8.5 μm for white. In addition, a toner charge amount is set to 53 μC/g for YMC, 58 μC/g for K. and 27 μC/g for white. A toner mass per area (TMA) is set to 3.3 g/m$^2$ for YMC, 3.7 g/m$^2$ for K, and 8.2 g/m$^2$ for white. As a transfer member of a primary transfer device, an elastic transfer roll of φ28, a resistance of 7.7 log Ω, and asker C hardness of 30° is used. A primary transfer current is set to 54 μA. An intermediate transfer belt as an intermediate transfer body to be used has a volume resistivity of 12.5 log Ω·cm obtained by dispersing carbon in polyimide. In a secondary transfer device, a belt transfer module in which an elastic transfer roll of φ28 of a resistance of 6.3 log Ω is covered with a rubber transfer transport belt having a thickness of 450 μm and φ40 of a volume resistivity of 9.2 log Ω and stretched with a peeling roll of φ20 is used, and as a facing roll, an elastic transfer roll having asker C hardness of 53° and φ28 of a surface resistance of 7.3 log Ω/□ is used via an intermediate transfer belt. Disposition of the image forming units 22 (22*a* to 22*f*) of each color is W (white)/Y/M/C/K/W (white).

For the paper S of A3 size black paper 256 gsm (ten-color jet-black paper) manufactured by Oji F-Tex Co., Ltd., a secondary transfer operation is performed with a solid image of a whole size of A3 of W (white)+Blue (see FIG. 14A) and a patch image in which an axial direction image width of W (white) and W (white)+Blue fluctuates (see FIG. 14B) by a switching method between constant voltage control and constant current control.

In addition, although ten-color jet-black paper usually has a resistance value of 12 to 13 log Ω·cm, according to a lot, approximately 6 log Ω·cm is mixed. In this case, for the experiment, a piece of paper of 6 log Ω·cm as the low resistance paper Sm and a piece of paper of 13 log Ω·cm as the non-low resistance paper Sh are prepared in advance and evaluated for each.

Comparative Example 1

Figure 14A:
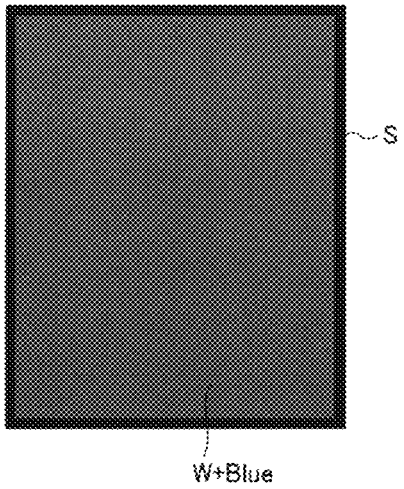
FIG. 14A is an explanatory diagram illustrating Image Forming Example 1 used in the image forming apparatus according to Example 1 and Comparative Examples 1 and 2.
Figure 14B:
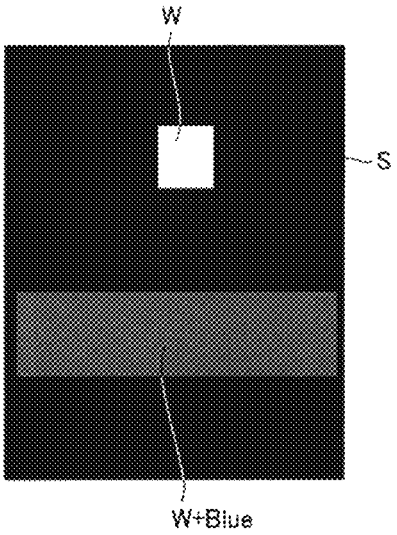
FIG. 14B is an explanatory diagram illustrating Image Forming Example 2 used in the image forming apparatus.

Comparative Example 1 uses an image forming apparatus having approximately the same configuration as that of Example 1, and performs the secondary transfer operation on the low resistance paper Sm and the non-low resistance paper Sh in the same manner as Example 1 with the solid image and the patch image illustrated in FIGS. 14A and 14B by the constant voltage control method.

Comparative Example 2

Comparative Example 2 uses an image forming apparatus having approximately the same configuration as that of Example 1, and performs the secondary transfer operation on the low resistance paper Sm and the non-low resistance paper Sh in the same manner as Example 1 with the solid image and the patch image illustrated in FIGS. 14A and 14B by the constant current control method.

An evaluation result for Example 1 and Comparative Examples 1 and 2 are illustrated in FIG. 15. In addition, the secondary transfer voltage is selected so that the solid image of a full width W (white)+Blue (see FIG. 14A) can be sufficiently transferred, and a secondary transfer voltage at the constant voltage control is set to 5.5 kV (set at 13 log Ω·cm product: an optimum value for transfer current path I), and a secondary transfer current at the constant current control is set to 120 μA.

According to FIG. 15, in Example 1, by switching to the constant voltage control for a 13 log Ω·cm product which is the non-low resistance paper Sh, an appropriately optimum image quality is obtained, and by switching to the constant current control for a 6 log Ω·cm product which is the low resistance paper Sm, a slight decrease in density occurs in the white patch, but an image quality of a passed level is obtained. As compared with the constant voltage control, in a case of switching to the constant current control, an image density fluctuation is weaker and depending on an image density, there may be some roughness or a drop in density. Meanwhile, in a case of selecting an appropriate secondary transfer current, it is possible to prevent a transfer failure due to a deviation of the appropriate secondary transfer voltage and a density level difference due to a change of the transfer current path, and it is possible to adjust to an allowable level.

On the other hand, in Comparative Example 1 (the constant voltage control method), the image quality obtained is not at an acceptable level for a 6 log Ω·cm product which is the low resistance paper Sm, and in Comparative Example 2 (the constant current control method), the image quality obtained is at an acceptable level for both a 13 log Ω·cm product which is the non-low resistance paper Sh and a 6 log Ω·cm product which is the low resistance paper Sm, but an optimum image quality cannot be obtained for a 13 log Ω·cm product.

Figure 16:
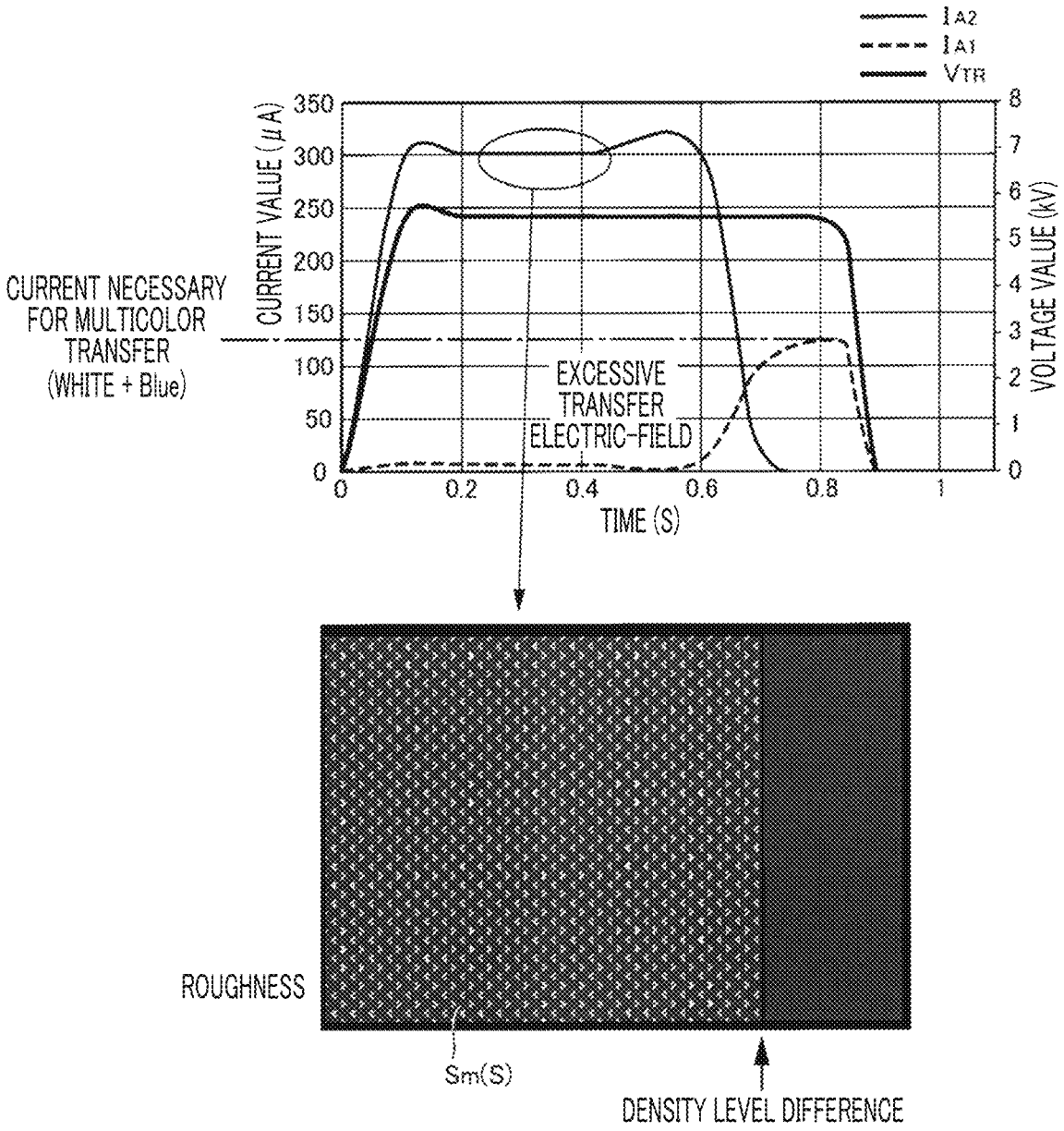
FIG. 16 is an explanatory diagram illustrating Transfer Operation Example 1 for a piece of low resistance paper of the secondary transfer unit of the image forming apparatus according to Comparative Example 1.

Further, in Comparative Example 1 (the constant voltage control method), changes of the voltage value of the transfer voltage $V_{TR}$ and the current value $I_{A1}$ and the current value $I_{A2}$ of the first ammeter and the second ammeter at the time of the secondary transfer operation on the 6 log Ω·cm product which is the low resistance paper Sm with the solid image of full width W (white)+Blue are monitored, and the results illustrated in FIG. 16 are obtained. In this case, since the transfer voltage $V_{TR}$ is selected in accordance with the non-low resistance paper Sh, the transfer electric-field becomes excessive while the transfer operation by the transfer current path II is performed on the low resistance paper Sm, so that roughness occurs in the transferred solid image. In addition, when the rear end of the low resistance paper Sm passes through the guide chute in the middle of the transfer operation on the low resistance paper Sm, the transfer operation by the transfer current path II is switched into the transfer operation by the transfer current path I on the rear end side of the low resistance paper Sm in the transport direction, the transfer electric-field works sufficiently, but a density level difference is seen between an excess region of the transfer electric-field and the transfer electric-field.

Figure 17:
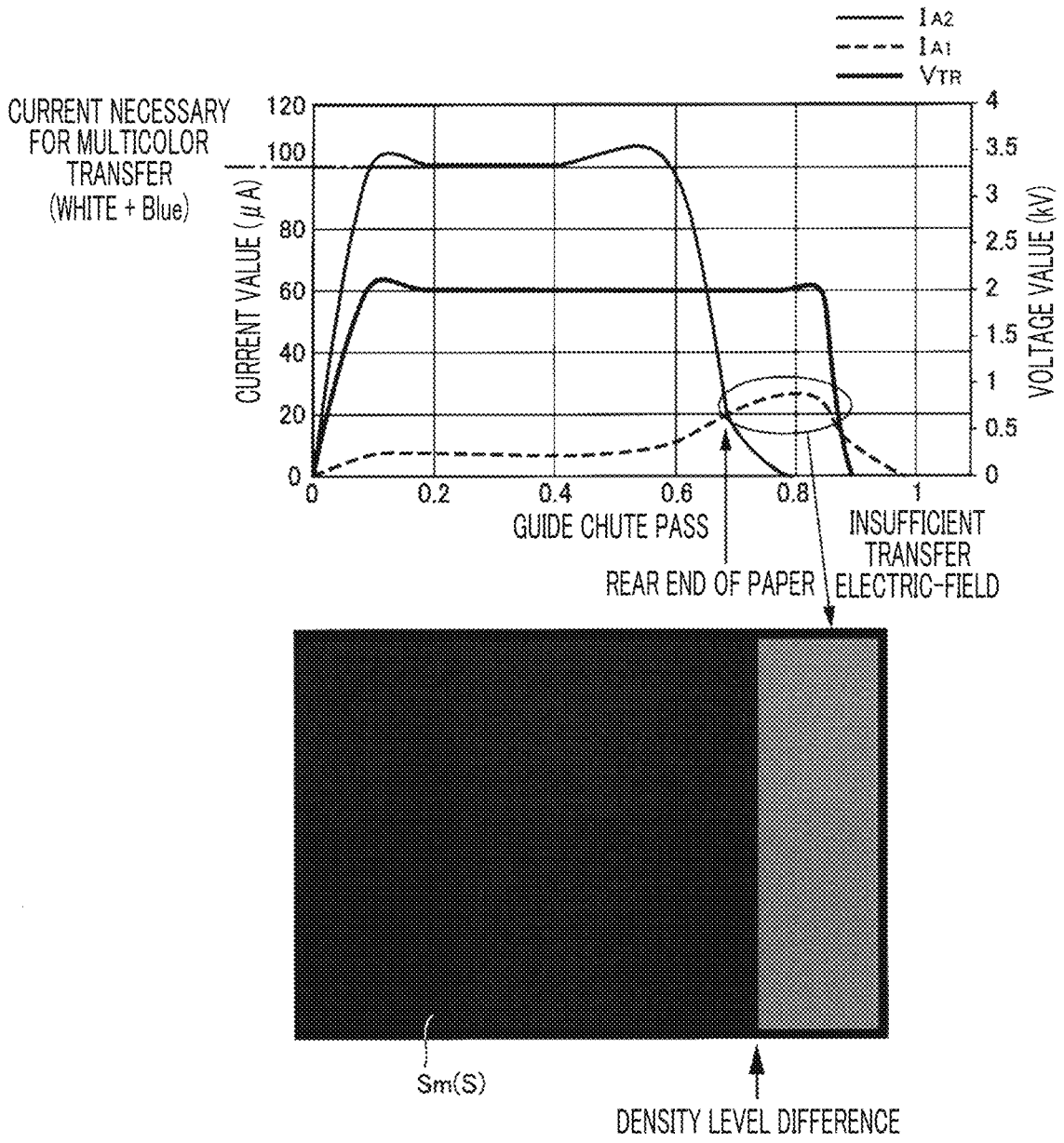
FIG. 17 is an explanatory diagram illustrating Transfer Operation Example 2 for a piece of low resistance paper of the secondary transfer unit of the image forming apparatus according to Comparative Example 1.

Further, in Comparative Example 1 (the constant voltage control method), the voltage value of the transfer voltage $V_{TR}$ is reduced to, for example, 2 kV so as to avoid the excess phenomenon of the transfer electric-field for the low resistance paper Sm. and changes of the voltage value of the transfer voltage $V_{TR}$ and the current value $I_{A1}$ and the current value $I_{A2}$ of the first ammeter and the second ammeter at the time of the secondary transfer operation on the low resistance paper Sm with the solid image of full width W (white)+Blue are monitored, and the results illustrated in FIG. 17 are obtained.

In FIG. 17, the transfer electric-field does not become excessive while the transfer operation by the transfer current path II is performed on the low resistance paper Sm, so that the transferred solid image has an acceptable level image quality. When the rear end of the low resistance paper Sm passes through the guide chute in the middle of the transfer operation on the low resistance paper Sm, the transfer operation by the transfer current path II is switched into the transfer operation by the transfer current path I on the rear end side of the low resistance paper Sm in the transport direction, so that the transfer electric-field is insufficient, and a density level difference is seen.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding section that holds an image;

a transfer section that includes a transfer member disposed in contact with an image holding surface of the image holding section and an opposite member disposed at a position facing the transfer member across the image holding section, connects a transfer power supply to the opposite member to apply a transfer electric-field to a transfer region between the image holding section and the transfer member, and electrostatically transfers the image held by the image holding section onto a recording medium transported to the transfer region;

a contact section that is provided upstream of the recording medium in a direction of transport of the recording medium across the transfer region and acts as an electrode to ground while being in contact with the recording medium when the recording medium passes through the transfer region;

a first resistance detection section that detects a system resistance between the transfer member, the image holding section, and the opposite member when the recording medium is interposed in the transfer region;

a second resistance detection section that detects a system resistance between the contact section, the image holding section, and the opposite member when the recording medium is interposed between the transfer region and the contact section;

a comparison section that compares a first system resistance detected by the first resistance detection section with a second system resistance detected by the second resistance detection section; and a switching section that switches between constant voltage control and constant current control for the transfer electric-field produced by the transfer section depending on a result of comparison by the comparison section.

2. The image forming apparatus according to claim 1, wherein the first resistance detection section and the second resistance detection section perform a detection operation when the recording medium passes through the transfer region in an image forming mode.

3. The image forming apparatus according to claim 2, wherein the first resistance detection section and the second resistance detection section perform a detection operation when a non-image forming region on a front end side of the recording medium in the transport direction passes through the transfer region.

4. The image forming apparatus according to claim 1, wherein the switching section selects the constant current control for the transfer electric-field produced by the transfer section when the second system resistance is smaller than the first system resistance.

5. The image forming apparatus according to claim 1, wherein the switching section selects the constant voltage control for the transfer electric-field produced by the transfer section when the second system resistance is equal to or larger than the first system resistance.

6. The image forming apparatus according to claim 1, wherein when the constant current control is selected for the transfer electric-field produced by the transfer section, different currents are set for the transfer electric-field produced by the transfer section depending on whether the image held by the image holding section is a monochromatic image or a multicolor image.

7. The image forming apparatus according to claim 1, wherein when the constant current control is selected for the transfer electric-field produced by the transfer section, the recording medium is allowed to pass at different speeds through the transfer region depending on whether the image held by the image holding section is a monochromatic image or a multicolor image.

8. The image forming apparatus according to claim 1, wherein the first resistance detection section and the second resistance detection section transport a detection-purpose recording medium of the same type as the recording medium to the transfer region and detect the detection-purpose recording medium in a non-image forming mode.

* * * * *